US008636551B2

(12) United States Patent
Skidmore

(10) Patent No.: US 8,636,551 B2
(45) Date of Patent: Jan. 28, 2014

(54) ELECTRICAL CONTACT WITH EMBEDDED WIRING

(75) Inventor: Allyssa M. Skidmore, New Ipswich, NH (US)

(73) Assignee: Hypertronics Corporation, Hudson, MA (US)

( * ) Notice: Subject to any disclaimer, the term of this patent is extended or adjusted under 35 U.S.C. 154(b) by 0 days.

(21) Appl. No.: 13/328,986

(22) Filed: Dec. 16, 2011

(65) Prior Publication Data

US 2012/0178317 A1 Jul. 12, 2012

Related U.S. Application Data

(60) Provisional application No. 61/430,723, filed on Jan. 7, 2011.

(51) Int. Cl.
*H01R 13/187* (2006.01)

(52) U.S. Cl.
USPC ..... 439/843; 439/851

(58) Field of Classification Search
USPC ..... 439/843–847, 851–854, 882
See application file for complete search history.

(56) References Cited

U.S. PATENT DOCUMENTS

| | | | | |
|---|---|---|---|---|
| 2,881,364 | A | 4/1959 | Demer et al. | |
| 3,107,966 | A | 10/1963 | Bonhomme | |
| 3,470,527 | A | 9/1969 | Bonhomme | |
| 3,557,428 | A * | 1/1971 | Bonhomme | 29/747 |
| 3,865,118 | A * | 2/1975 | Bures | 607/123 |
| 3,873,889 | A | 3/1975 | Leyba | |
| 4,203,647 | A | 5/1980 | Bonhomme | |
| 4,411,277 | A * | 10/1983 | Dickhudt | 607/116 |
| 4,437,726 | A | 3/1984 | Lambert | |
| 4,447,108 | A | 5/1984 | Ghigliotti et al. | |
| 4,720,157 | A | 1/1988 | Nestor et al. | |
| 4,811,165 | A | 3/1989 | Currier et al. | |
| 4,922,199 | A | 5/1990 | Fukui et al. | |
| 4,958,260 | A | 9/1990 | Kobayashi et al. | |
| 5,324,321 | A * | 6/1994 | Pohndorf et al. | 607/116 |
| 5,326,289 | A | 7/1994 | Leisey | |
| 5,599,348 | A | 2/1997 | Gentelia et al. | |
| 5,920,750 | A | 7/1999 | Wayman et al. | |
| 6,016,253 | A | 1/2000 | Seitz et al. | |
| 6,102,746 | A * | 8/2000 | Nania et al. | 439/675 |
| 6,102,907 | A | 8/2000 | Smethers et al. | |
| 6,164,838 | A | 12/2000 | Maehara et al. | |
| 6,165,173 | A | 12/2000 | Kamdar et al. | |
| 6,264,476 | B1 | 7/2001 | Li et al. | |
| 6,296,636 | B1 | 10/2001 | Cheng et al. | |
| 6,471,554 | B2 | 10/2002 | Armistead et al. | |
| 6,511,478 | B1 | 1/2003 | Burnside et al. | |

(Continued)

FOREIGN PATENT DOCUMENTS

| | | |
|---|---|---|
| WO | WO 00/40065 | 7/2000 |

*Primary Examiner* — Thanh Tam Le
(74) *Attorney, Agent, or Firm* — Finnegan, Henderson, Farabow, Garrett & Dunner LLP

(57) ABSTRACT

Embodiments include an electrical contact including a tubular body formed of a flexible and insulative material. The tubular body includes an inner surface. The electrical contact also includes at least one wire partially embedded into the tubular body such that at least a portion of the at least one wire is exposed within the inner surface of the tubular body. At least a portion of the inner surface of the tubular body and at least the exposed portion of the at least one wire forms a channel.

20 Claims, 26 Drawing Sheets

(56) References Cited

U.S. PATENT DOCUMENTS

| | | | | |
|---|---|---|---|---|
| 6,515,228 | B2 | 2/2003 | Albert et al. | |
| 6,617,518 | B2 | 9/2003 | Ames et al. | |
| 6,712,620 | B1 | 3/2004 | Li et al. | |
| 6,761,574 | B1 | 7/2004 | Song et al. | |
| 6,767,260 | B2 | 7/2004 | Beloritsky et al. | |
| 6,848,922 | B2 * | 2/2005 | Coughlan et al. | 439/181 |
| 6,849,074 | B2 | 2/2005 | Chen et al. | |
| 6,923,057 | B2 | 8/2005 | Sabatino | |
| 7,040,902 | B2 | 5/2006 | Li | |
| 7,048,586 | B2 | 5/2006 | Ishizaki et al. | |
| 7,517,226 | B2 | 4/2009 | Kawam et al. | |
| 7,794,255 | B2 | 9/2010 | Melni | |
| 7,805,838 | B2 * | 10/2010 | Morana et al. | 29/868 |
| 2009/0061700 | A1 | 3/2009 | Coe et al. | |
| 2010/0234872 | A1 | 9/2010 | Guo et al. | |

* cited by examiner

ELECTRICAL CONTACT WITH EMBEDDED WIRING

This application claims the benefit of priority from U.S. Provisional Application No. 61/430,723, filed Jan. 7, 2011, which is herein incorporated by reference in its entirety.

FIELD

The present disclosure relates generally to an electrical contact, and more particularly, to materials, components, and methods directed to the fabrication and use of an electrical contact with embedded wiring.

BACKGROUND

A conventional electrical connector may include a flexible pin member that is received within a tubular receiving connector member to form an electrical connection. For example, U.S. Pat. No. 4,437,726 to Lambert ("the '726 patent") discloses a flexible pin member for inserting into a tubular receiving connector. The flexible pin member includes a pair of fingers that curve away from each other and then toward each other along the lengths of the fingers. As the fingers are inserted into a tubular receiving connector, the relatively wider portion of the pin member (formed where the fingers curve away from each other) is compressed and slides against an inner surface of the tubular receiving connector, thereby resulting in an electrical connection between the flexible pin member and the tubular receiving connector.

The electrical connector of the '726 patent, however, includes components, such as the fingers, that may be complex to manufacture. For example, due to the size and/or shape of the fingers, the fingers may generally be expensive and difficult to manufacture. Also, for applications that may need smaller electrical connectors, it may be difficult to decrease the size of the fingers without significantly increasing the cost and difficulty in manufacturing.

Other electrical connectors may include wires that form a hyperboloid. There may generally be a limit to how small such connectors may be made. Also, due to their manufacturing complexity and number of components, such connectors may generally be expensive.

The disclosed embodiments are directed to overcoming one or more of the problems set forth above.

SUMMARY

In accordance with an embodiment, an electrical contact includes a tubular body formed of a flexible and insulative material. The tubular body includes an inner surface. The electrical contact also includes at least one wire partially embedded into the tubular body such that at least a portion of the at least one wire is exposed within the inner surface of the tubular body. At least a portion of the inner surface of the tubular body and at least the exposed portion of the at least one wire forms a channel.

In accordance with another embodiment, an electrical connector includes an electrical contact including a tubular body formed of at least one of a polymeric material or an elastomeric material. The tubular body includes an inner surface. The electrical contact also includes at least one wire partially embedded into the tubular body such that at least a portion of the at least one wire is exposed within the inner surface of the tubular body. At least a portion of the inner surface of the tubular body and at least the exposed portion of the at least one wire forms a channel.

In accordance with a further embodiment, a method of forming an electrical connector includes forming at least one wire partially embedded into a tubular body. The tubular body is formed of a flexible and insulative material. The at least one wire is formed of a conductive material. The tubular body includes an inner surface. At least a portion of the at least one wire is exposed within the inner surface of the tubular body so that at least a portion of the inner surface of the tubular body and at least the exposed portion of the at least one wire forms a channel.

Additional embodiments and advantages will be set forth in part in the description which follows, and in part will be obvious from the description, or may be learned by practice of the disclosure. The embodiments and advantages will be realized and attained by means of the elements and combinations particularly pointed out below.

It is to be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate several embodiments and together with the description, serve to explain the principles of the disclosure.

DESCRIPTION OF THE EMBODIMENTS

Reference will now be made in detail to exemplary embodiments, examples of which are illustrated in the accompanying drawings. Wherever possible, the same reference numbers will be used throughout the drawings to refer to the same or like parts.

Figure 1:
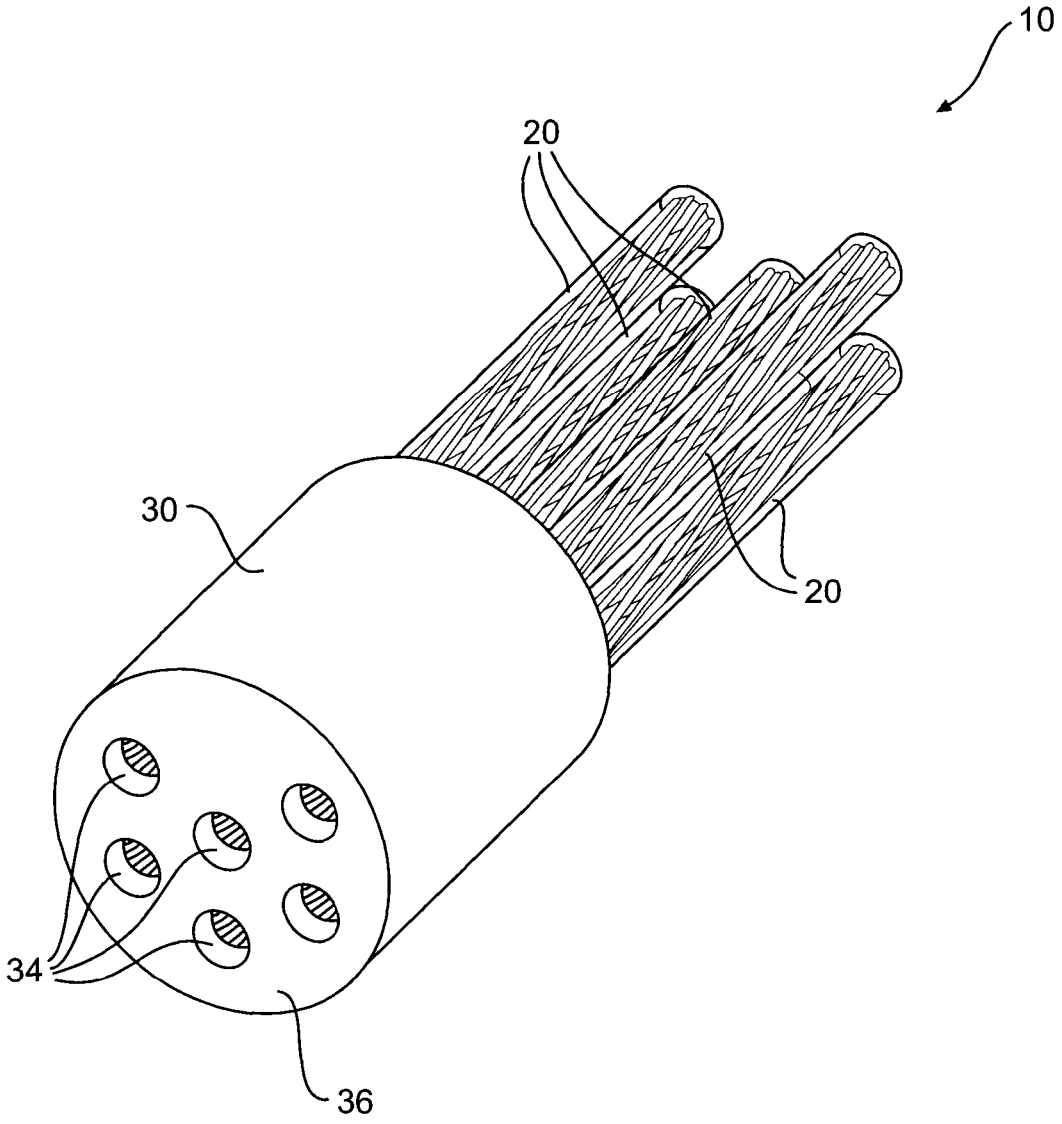
FIG. 1 is a perspective view of an electrical connector, according to an exemplary embodiment.
Figure 2:
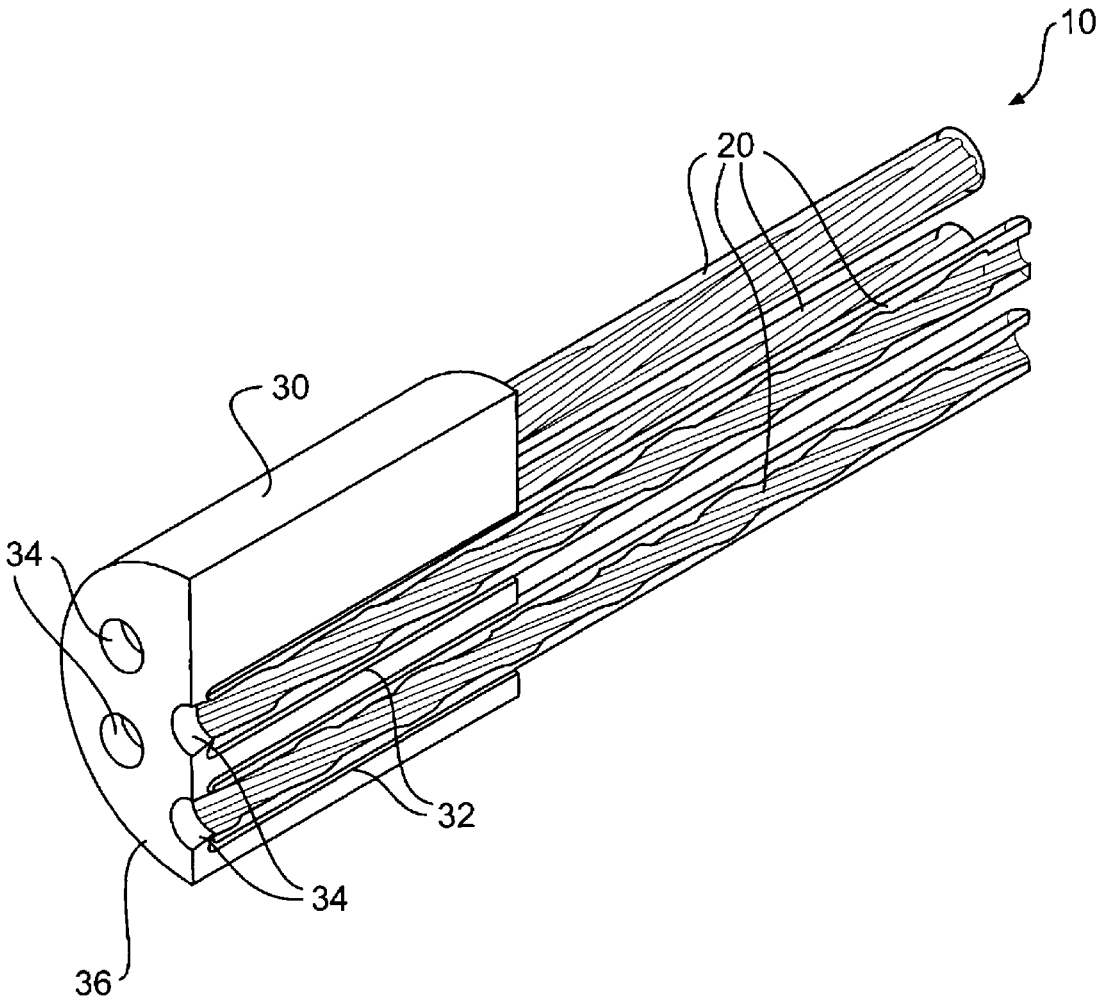
FIG. 2 is a cross-sectional view of the electrical connector of FIG. 1.
Figure 3:
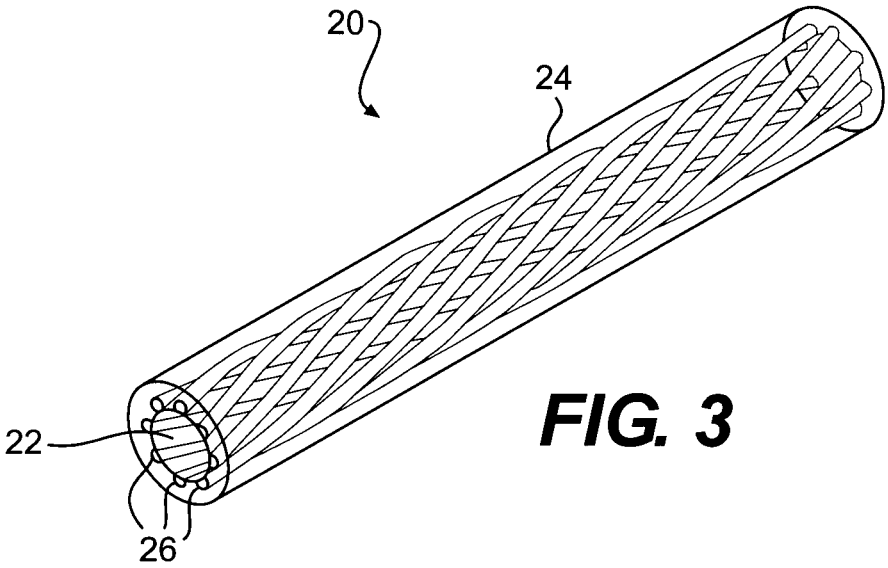
FIG. 3 is a perspective view of an electrical contact of the electrical connector of FIGS. 1 and 2 having wires in a helical configuration.
Figure 4:
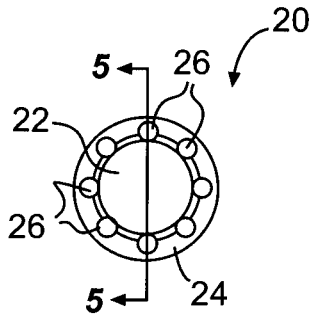
FIG. 4 is a front view of the electrical contact of FIG. 3.
Figure 5:
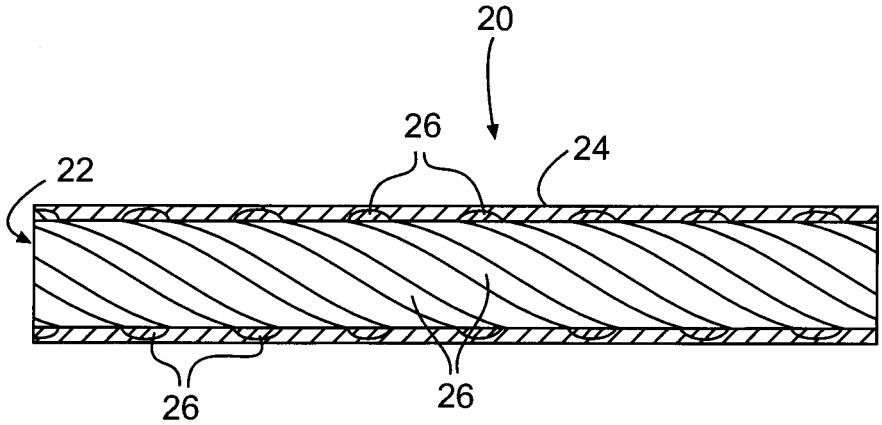
FIG. 5 is a cross-sectional side view of the electrical contact of FIG. 3.

FIGS. 1 and 2 show an electrical connector 10, according to an exemplary embodiment. In the exemplary embodiment, the electrical connector 10 is a plug (or socket) connector that is configured to contact and connect with a receptacle connector (not shown). The electrical connector 10 includes one or more electrical contacts (or sockets) 20. As shown in FIGS. 3-5, each electrical contact 20 may include a channel 22 for receiving a pin or other conductive structure (e.g., the pin 80 of FIG. 31), as will be described below in further detail. The term "channel" is used to describe any type of opening or passage extending through the electrical contact 20, such as the opening or passage shown in the figures, or any other opening or passage that permits entrance of the pin or other conductive structure. The length of the electrical contact 20 may vary depending on the application.

As shown in FIGS. 1 and 2, the electrical connector 10 may also include a housing 30 or other carrier device for receiving the electrical contact 20. The housing 30 or other carrier device may be connected to ends of the electrical contacts 20. For example, the housing 30 or other carrier device may permit the electrical contact 20 to be removably or permanently attached to another component (e.g., a component including a pin or other conductive structure (e.g., the pin 80 of FIG. 31)) to form an electrical connection with that component, as will be described below. The housing 30 may be formed of polyetherimide (PEI), liquid crystal polymer (LCP), other polymers, or other similar materials. In certain embodiments, the housing 30 may also be formed, partially or entirely, from a metal or other conductive materials.

The housing 30 may include one or more cavities 32 extending through the axial length of the housing 30, which form openings 34 in a face 36 of the housing 30. The term "cavity" is used to describe any type of opening or passage extending through the housing 30, such as the opening or passage shown in the figures, or any other opening or passage that permits entrance of the electrical contact 20. In the embodiment shown in FIGS. 1 and 2, the housing 30 includes six cavities 32, but alternatively, fewer or more than six cavities 32 may be provided, e.g., depending on the application.

The electrical contacts 20 may be inserted at least partially through the cavities 32. As shown in FIG. 2, the electrical contacts 20 extend through substantially the entire length of the cavities 32. The electrical contacts 20 may be permanently attached to the inner surfaces of the respective cavities 32 by a variety of methods, for example, by use of an adhesive. Alternatively, the electrical contacts 20 may be attached to the inner surfaces of the respective cavities 32 by, e.g., using a cable connector or cable gland, such as a threaded connection, such that the electrical contacts 20 may be removable.

When a receptacle connector (not shown) is connected to the electrical plug connector 10, pins (e.g., the pin 80 of FIG. 31) in the receptacle connector may be inserted through the openings 34 in the face 36 of the housing 30 such that the pins are received by the channels 22 in the electrical contacts 20 disposed within the cavities 32 of the housing 30. When the pins are inserted into the channels 22 in the electrical contacts 20, an electrical connection may be formed between the pins of the receptacle connector and the electrical contacts 20, as will be described below in detail.

FIGS. 3-5 show the electrical contact 20, according to an exemplary embodiment. The electrical contact 20 includes a generally tubular body 24. The tubular body 24 may be formed from a flexible, insulative material, such as rubber, plastic, thermoplastic, polyurethane, other elastomeric polymers, or other similar polymeric and/or elastomeric materials. Thus, since the tubular body 24 may be formed from an insulative material, the housing 30 may be formed, partially or entirely, from a conductive material, as described above. The tubular body 24 may be generally cylindrical, or may have a tubular cross-section of other shapes, such as rectangular, square, oval, etc. In an embodiment, the outer surface of the tubular body 24 may be approximately 0.61 millimeters (0.024 inches) in diameter and the inner surface of the tubular body 24 may be approximately 0.25 millimeters (0.010 inches) in diameter.

Figure 9:
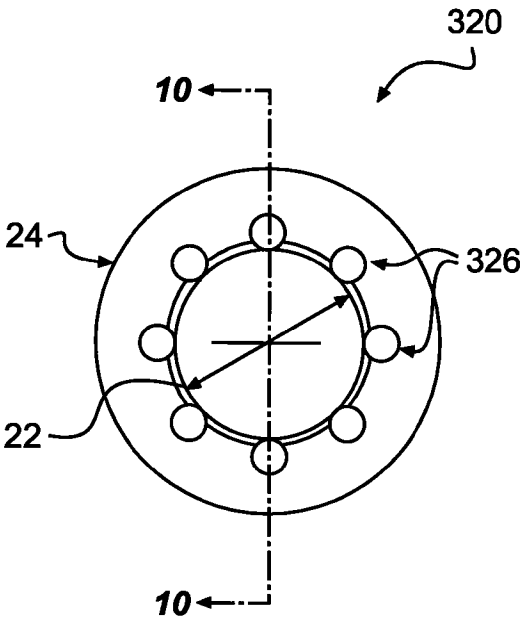
FIG. 9 is a front view of one of the electrical contacts of FIG. 8.

One or more conducting wires 26 may be embedded into the surface of the tubular body 24 so that the exposed portions of the wires 26 and the inner surface of the tubular body 24 between the exposed portions of the wires 26 may form the channel 22. For example, as shown in FIGS. 4 and 9, the exposed portions of the wires 26 (or 326) may form an inner diameter (or other dimension) that is smaller than an inner diameter (or other dimension) of the tubular body 24 so that the exposed portions of the wires 26 (or 326) protrude radially inward from an inner surface of the tubular body 24. Alternatively, the wires 26 (or 326) may form an inner diameter (or other dimension) that is generally similar to the inner diameter (or other dimension) of the tubular body 24.

The channel 22 may extend at least partially through the structure formed by the tubular body 24 and the exposed portions of the wires 26. For example, as shown in FIGS. 3 and 5, the channel 22 may extend generally between and through the ends of the tubular body 24, and substantially longitudinally (axially) within the tubular body 24. The wires 26 may extend substantially longitudinally (axially) along the surface of the tubular body 24, and generally between the ends of the tubular body 24. The wires 26 may be gold-plated (such as gold-plated beryllium copper) and/or may be made of a variety of materials including, but not limited to, brass, beryllium, copper, and/or any conventional conductive material used for electrical connectors. The possible types of conductive materials may range from materials having relatively lower electrical conductivity (e.g., titanium, stainless steel, etc.), for example, for implantable applications, to materials having relatively higher electrical conductivity. The wires 26 may have a cross-section that is generally circular, oval, or square, or may have another shape. In an embodiment, the wires 26 may be approximately 0.069 millimeters (0.0027 inches) in diameter. The wires 26 may be positioned in various configurations. In the exemplary embodiment shown in FIGS. 1-5, eight wires 26 with generally circular cross-section are provided, and each wire 26 is formed in spiral or helical configuration. Alternatively, fewer or more than eight wires 26 may be provided, and the wires 26 may have other shapes or configurations. For example, the electrical contact 20 may include three, five, or more wires 26.

Figure 6:
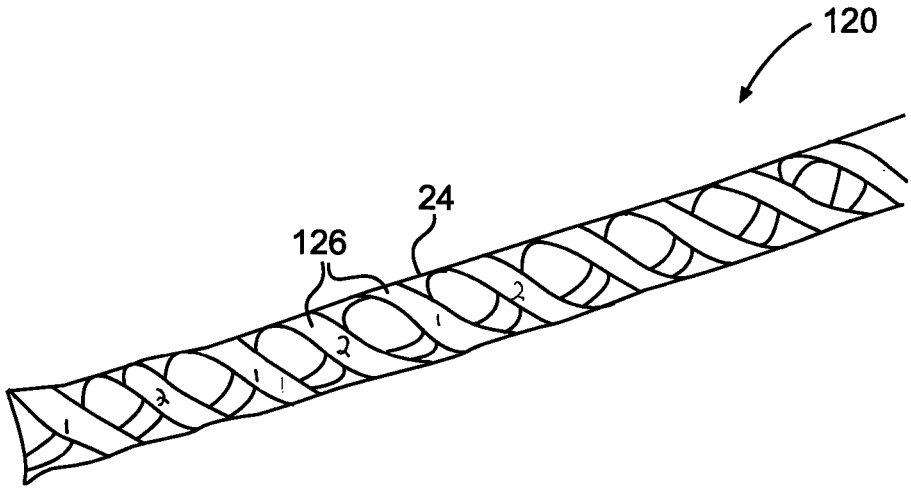
FIG. 6 is a perspective view of an electrical contact having wires in a helical configuration, according to an alternative embodiment.

Alternative exemplary electrical contacts having different numbers and configurations of wires are shown in FIGS. 6-10. FIG. 6 shows an exemplary electrical contact 120 that includes fewer wires 126 than the electrical contact 20 shown in FIGS. 1-5. As shown in FIG. 6, the electrical contact 120 includes two wires 126 formed in helical configurations, and the wires 126 are generally ribbon-like and have a relatively flatter cross-section. In the exemplary embodiment shown in FIG. 6, the two helical wires 126 remain parallel to each other as they extend along the length of the tubular body 24. Also, in the exemplary embodiment shown in FIG. 6, the two helical wires 126 are approximately 180 degrees out of phase with respect to each other. Alternatively, multiple helical wires may be provided in a criss-cross configuration (e.g., contacting each other at one or more locations) or a braided configuration. As another alternative, the electrical contact may include a single wire (e.g., in a helical or mesh configuration, etc.) or other substantially continuous wire configuration.

Figure 7:
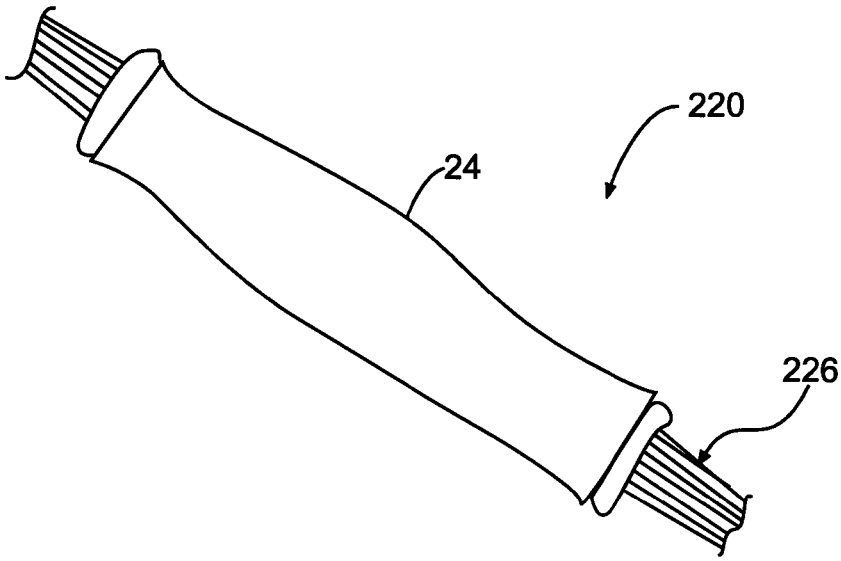
FIG. 7 is a perspective view of an electrical contact having wires in a generally straight configuration, according to another alternative embodiment.

FIG. 7 shows an exemplary electrical contact 220 that includes more wires 226 than the electrical contact 20 shown in FIGS. 1-5. As shown in FIG. 7, the electrical contact 220 includes a plurality of wires 226 that extend generally longitudinally (axially) and are relatively straight and generally parallel to the longitudinal axis and to each other.

Figure 8:
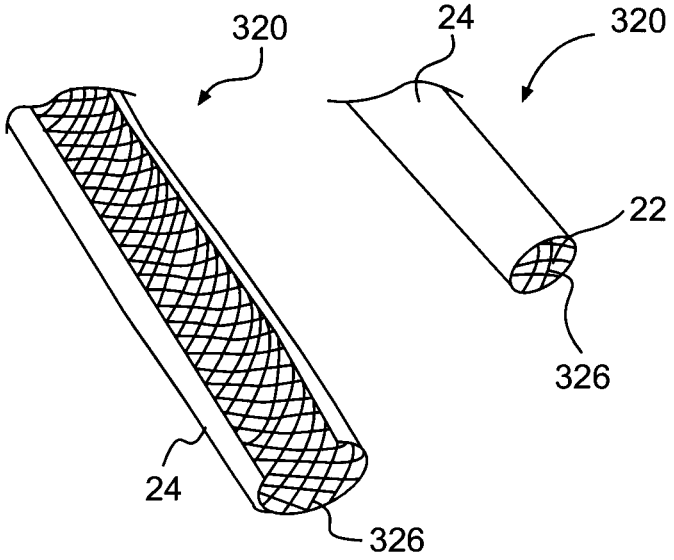
FIG. 8 is a perspective view of electrical contacts having wires in a braided configuration, according to a further alternative embodiment.
Figure 10:
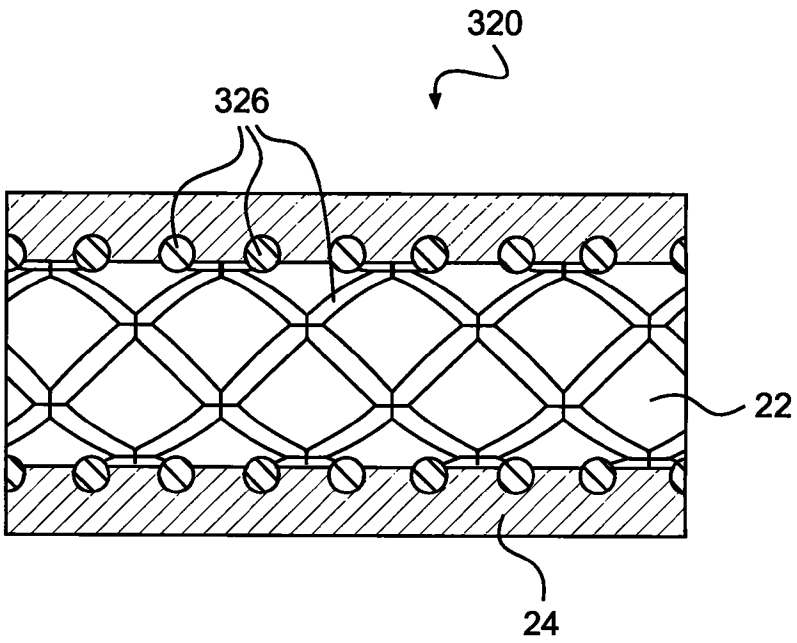
FIG. 10 is a cross-sectional side view of one of the electrical contacts of FIG. 8.

FIGS. 8-10 show an exemplary electrical contact 320 that includes wires 326 provided in a braided or criss-cross configuration. The wires 326 may be attached or joined together (e.g., joined with adhesive, formed continuously, etc.), or may be braided together at the locations where the wires 326 cross. FIG. 8 shows the electrical contact 320 cut open for illustrative purposes only. With the braided configuration, certain portions or wires 326 of the braided configuration may be embedded in the tubular body 24, and certain portions or wires 326 of the braided configuration may not be embedded in the tubular body 24. The portions or wires 326 that are not embedded in the tubular body 24 may be connected to the tubular body 24 by the portions or wires 326 that are embedded in the tubular body 24, which are braided or criss-crossed with the non-embedded portions or wires 326. Alternatively, other configurations of wires may be provided, such as a mesh. The configuration of the wires 26, 126, 226, 326 may be selected based on various factors, such as a desired amount of exposed surface area that may contact the pin or other conductive structure inserted into the channel 22.

The following disclosure refers to the exemplary electrical contact 20 shown in FIGS. 1-5 or the electrical contact 320 shown in FIGS. 8-10, but it is understood that any of the electrical contacts set forth herein may be substituted for the electrical contacts 20, 320 described below. Any aspect set forth in any embodiment may be used with any other embodiment set forth herein.

Referring back to the electrical contact 20 shown in FIGS. 1-5, at least a portion of the wires 26 may be embedded within the tubular body 24. As a result, the wires 26 may retain their positioning with respect to the tubular body 24 as a pin or other conductive structure (e.g., from the receptacle connector) is inserted into and/or removed from the channel 22. Also, the wires 26 are substantially prevented from obstructing the channel 22, so that the pin or other conductive structure (e.g., from the receptacle connector) may enter the channel 22. In an exemplary embodiment, at least a majority (e.g., greater than 50%, 75%, 95%, etc.) of each wire 26 (e.g., a volume or a surface thereof) may be embedded within the tubular body 24, as shown in FIGS. 3-5. Alternatively, less than a majority (e.g., less than 50%, etc.) of each wire 26 (e.g., a volume or a surface thereof) may be embedded within the tubular body 24. The remaining portion of each wire 26 (or the surface thereof) is exposed within the channel 22. As a result, the pin or other conductive structure may contact and form an electrical connection with the exposed portions of the wires 26 when inserted into the channel 22.

The tubular body 24 has sufficient thickness to electrically insulate the wires 26 from an outer surface of the tubular body 24. As a result, each electrical contact 20 may provide a separate electrical connection between the wires 26 and the pin or other conductive structure inserted into the channel 22 in the respective electrical contact 20.

The dimension of the channel 22 (e.g., the diameter of the inner surfaces of the wires 26) may be slightly smaller than the dimensions of the pin or other conductive structure (e.g., the diameter of the outer surface configured to contact the wires 26). Thus, the polymeric and/or elastomeric material of the tubular body 24 may expand when the pin or other conductive structure is inserted into the channel 22. The polymeric and/or elastomeric material of the tubular body 24 may also provide sufficient radial pressure or force when the pin or other conductive structure is inserted into the channel 22 such that the wires 26 may be maintained in contact with the pin or other conductive structure (e.g., to prevent the pin or other conductive structure from inadvertently slipping out of the channel 22 as well as to provide sufficient normal force to ensure an uninterrupted connection having low resistance). The dimensions of the tubular body 24 (e.g., the diameter of the inner surface of the tubular body 24, the thickness of the tubular body 24, etc.) and/or the pin or other conductive structure (e.g., the diameter of its outer surface configured to contact the wires 26), the configuration (e.g., helical, braided, straight, etc.) and/or dimensions (e.g., the cross-sectional thickness, the size of the exposed portions forming the channel 22, etc.) of the wires 26, and/or the polymeric and/or elastomeric material used to form the tubular body 24 (e.g., the flexibility of the material) may be selected to ensure that sufficient radial pressure is applied to the pin or other conductive structure when inserted into the channel 22. As a result, due to the flexibility of the tubular body 24, it may not be necessary to size the components of the electrical contact 20 and/or the pin or other conductive structure to within as narrow a tolerance when manufacturing the respective components. With the above configuration, the wires 26 may be pre-biased in the inward radial direction, which may result in an improved amount of surface area contact with the pin or other conductive structure when it is inserted. This may also result in an improved electrical connection between the electrical contact 20 and the pin. Moreover, having a plurality of such wires 26 may increase the amount of surface area contact with the pin.

The tubular body 24 and the wires 26 may be formed using various methods. In an exemplary embodiment, the tubular body 24 and the wires 26 may be formed such that the tubular body 24 and the wires 26 are seamless and continuous. The tubular body 24 may be continuously tubular and may have a constant cross-section, and the wires 26 may extend continuously along the length (or axis) of the tubular body 24 without any cuts along the cross-sections of the wires 26.

In an exemplary embodiment, the wires 26 may be braided, wound, or otherwise positioned over a wire core (not shown), which may be, for example, a cylindrical member. The subassembly formed by the wires 26 positioned on the wire core may be run through an extruder to form the tubular body 24 over the wires 26 such that the wires 26 are embedded into the tubular body 24 as shown in FIGS. 1-5. Then, the wire core may be removed to produce a continuous and seamless length of the tubular body 24 with the wires 26 embedded therein, which may be divided or cut into multiple individual electrical contacts 20. The individual electrical contacts 20 may then be continuous and seamless. Alternatively, when forming multiple electrical contacts 20, multiple subassemblies (including the wires 26 positioned on the respective wire cores) may be formed and may be run together through a single extruder to form the respective tubular bodies 24 simultaneously. Accordingly, multiple individual electrical contacts 20 may be extruded together in a single bundle.

In another exemplary embodiment, the wires 26 may be braided, wound, or otherwise positioned over the wire core, and a tube formed of the material for forming the tubular body 24 (e.g., a polymer or other material capable of softening when heated, or other similar material) may be slipped over the subassembly formed by the wires 26 positioned on the wire core. A shrink tube (not shown) may be slipped over the polymer tube. The assembly including the shrink tube, the polymer tube, the wires 26, and the wire core, may be heated, which may cause the shrink tube to shrink and apply radial pressure against the polymer tube while the polymer tube softens. Then, the shrink tube and the wire core may be removed to produce a continuous and seamless length of the tubular body 24 with the wires 26 embedded therein, which may be divided or cut into multiple individual electrical contacts 20. The individual electrical contacts 20 may then be continuous and seamless.

The lengths of the individual electrical contacts 20 may be determined based on the intended applications. For example, in certain applications, the lengths of the electrical contacts 20 may range from approximately 12 millimeters (0.5 inches) to approximately 305 millimeters (12 inches). Since the electrical contacts 20 may be divided or cut from a continuous and seamless length of the tubular body 24 with the wires 26 embedded therein, manufacturing and assembling the electrical contacts 20 may be easier and less expensive.

Accordingly, the dimensions of the electrical contact 20 may be scaled up or down relatively easily. The electrical contact 20 may be relatively inexpensive to manufacture and may require minimal assembly. Minimal tooling (e.g., an extrusion die) may be required to form the electrical contact 20.

The housing 30 shown in FIGS. 1 and 2 may be omitted, replaced, or substituted by other carrier devices that may be attached to the ends of one or more of the electrical contacts 20 to form a contact assembly and/or an electrical connector. Various exemplary electrical connections provided by the electrical contacts 20, 320 will now be described.

In certain embodiments, an electrical connection may be formed by connecting the electrical contact 20 to an insulated conductor 40 (e.g., an insulated wire) or other termination device that is at least partially inserted into the electrical contact 20. As shown in FIGS. 11-15, the conductor 40 may include a conductive inner portion 42 and an insulative outer portion 44 surrounding the inner portion 42 along at least a portion of the length of the inner portion 42, with an end of the inner portion 42 extending outward from the outer portion 44. The inner portion 42 may be formed from an electrically conductive material, such as any of the materials described above for forming the wires 26. The outer portion 44 may be electrically insulative. Alternatively, the entire conductor 40 may be formed of a conductive material. As described below, the inner portion 42 may be electrically connected to the wires 26 of the electrical contact 20. In an embodiment, a pin or other conductive structure (e.g., of a receptacle connector) (e.g., the pin 80 of FIG. 31) or other termination device may be inserted into the channel 22 of the electrical contact 20 to electrically connect to the inner portion 42, thereby establishing an electrical connection with the conductor 40 and the electrical contact 20.

Figure 11:
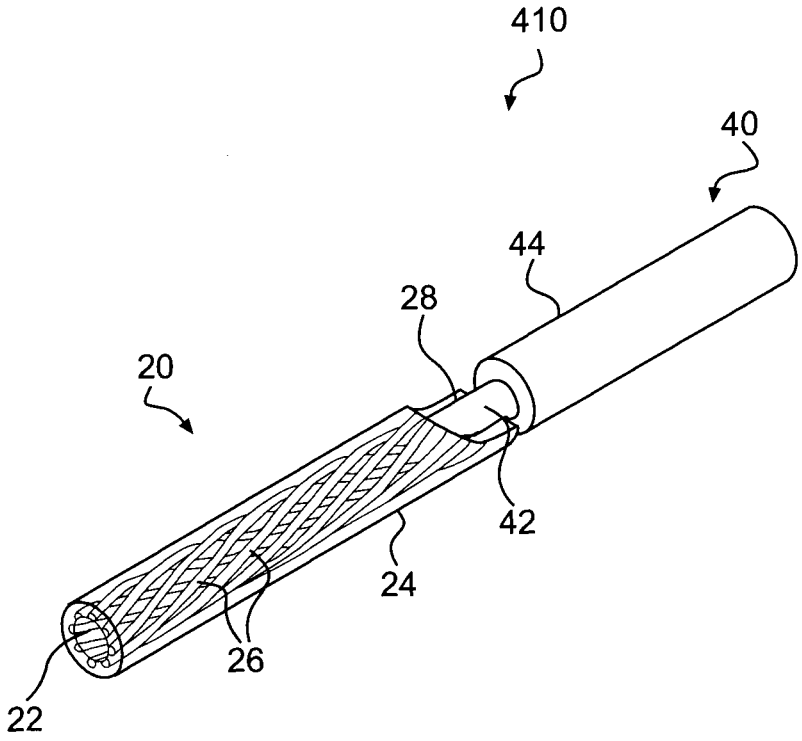
FIG. 11 is a perspective view of a contact assembly including a conductor and an electrical contact, according to an exemplary embodiment.

FIG. 11 shows a contact assembly 410 formed by soldering the conductor 40 to the electrical contact 20, according to an exemplary embodiment. Before soldering the conductor 40 to the electrical contact 20, the electrical contact 20 may be prepared. For example, a portion of the electrical contact 20 may be cut away to form a solder cup 28 at the end of the electrical contact 20, when the electrical contact 20 is positioned horizontally, as shown in FIG. 11. The exposed end of the inner portion 42 of the conductor 40 may be sized to be received in the portion of the channel 22 in the solder cup 28. After inserting the exposed end of the inner portion 42 in the solder cup 28, solder may be applied to the solder cup 28 to solder the wires 26 in the solder cup 28 to the exposed end of the inner portion 42. As a result, the inner portion 42 may be electrically connected to the wires 26 of the electrical contact 20. A shrink tube or ferrule 46 (FIGS. 14 and 15) may be provided to cover and support the connection between the conductor 40 and the electrical contact 20 (e.g., the solder cup 28). Accordingly, an electrical connection may be provided between the conductor 40 and the electrical contact 20.

Figure 13:
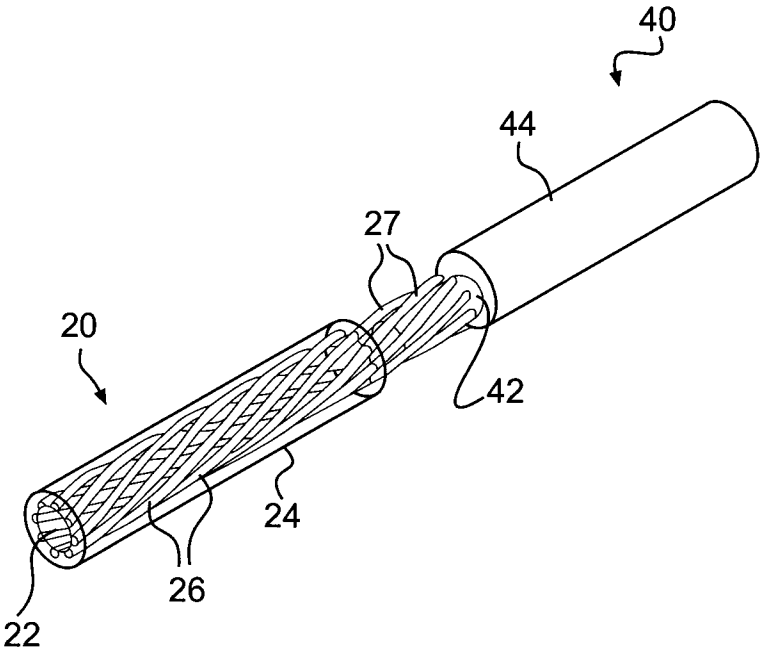
FIG. 13 is a perspective view of a contact assembly including a conductor and the electrical contact of FIG. 12.
Figure 12:
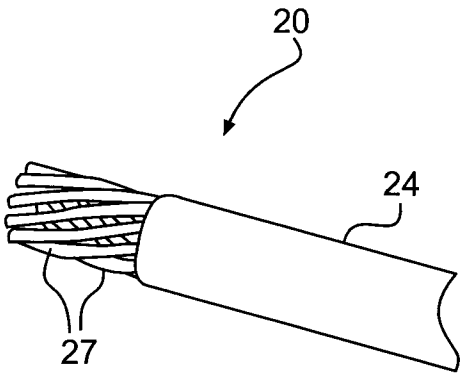
FIG. 12 is a perspective view of an electrical contact having embedded wires with exposed ends, according to an exemplary embodiment.
Figure 14:
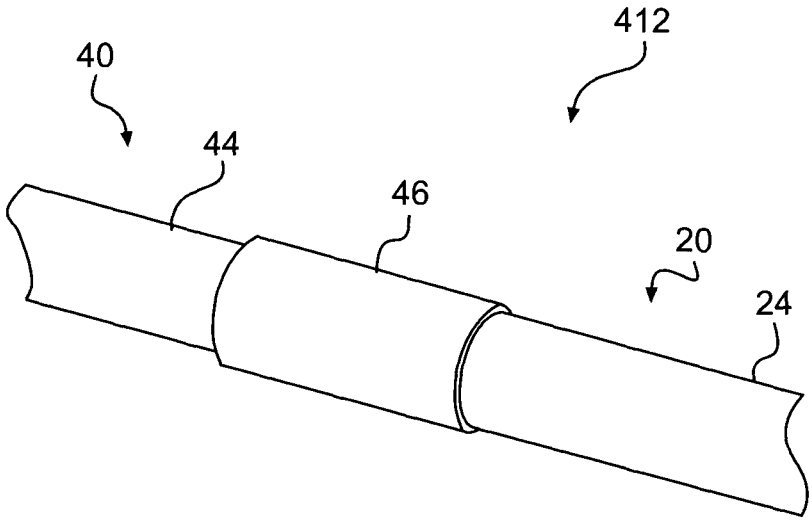
FIG. 14 is a perspective view of the contact assembly of FIG. 13 including a crimp ferrule.
Figure 15:
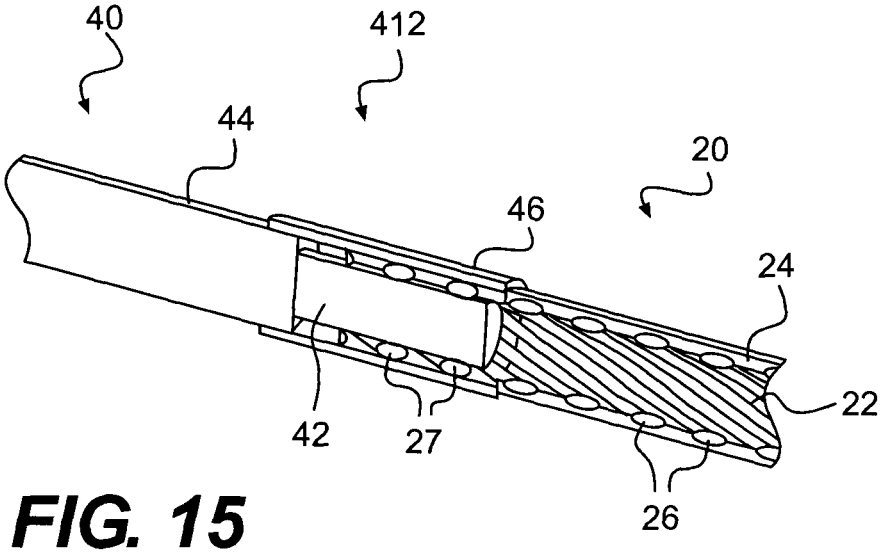
FIG. 15 is a cross-sectional perspective view of the contact assembly of FIG. 14.

FIGS. 12-15 show a contact assembly 412 formed by soldering or crimping the electrical contact 20 to the conductor 40, according to an exemplary embodiment. Before soldering or crimping the conductor 40 to the electrical contact 20, the electrical contact 20 may be prepared. For example, as shown in FIG. 12, a portion of the tubular body 24 of the electrical contact 20 may be cut away to expose ends 27 of the wires 26, e.g., using a wire strip tool. As shown in FIG. 13, the exposed end of the inner portion 42 of the conductor 40 may be placed between the exposed ends 27 of the wires 26. The exposed ends 27 of the wires 26 may be soldered to the exposed end of the inner portion 42 of the conductor 40. As shown in FIGS. 14 and 15, a shrink tube or ferrule 46 (e.g., a crimp ferrule) may be provided to cover and support the connection between the conductor 40 and the electrical contact 20. Alternatively, the exposed ends 27 of the wires 26 may be crimped to the exposed end of the inner portion 42 of the conductor 40 using the ferrule 46 (e.g., a crimp ferrule). As a result, the inner portion 42 may be electrically connected to the wires 26 of the electrical contact 20. Alternatively, instead of stripping away a portion of the tubular body 24 to expose the ends 27 of the wires 26, the end of the electrical contact 20 (including the wires 26 and the tubular body 24) may be crimped onto the exposed end of the inner portion 42 of the conductor 40 using the crimp ferrule 46. Accordingly, an electrical connection may be provided between the conductor 40 and the electrical contact 20.

Figure 16:
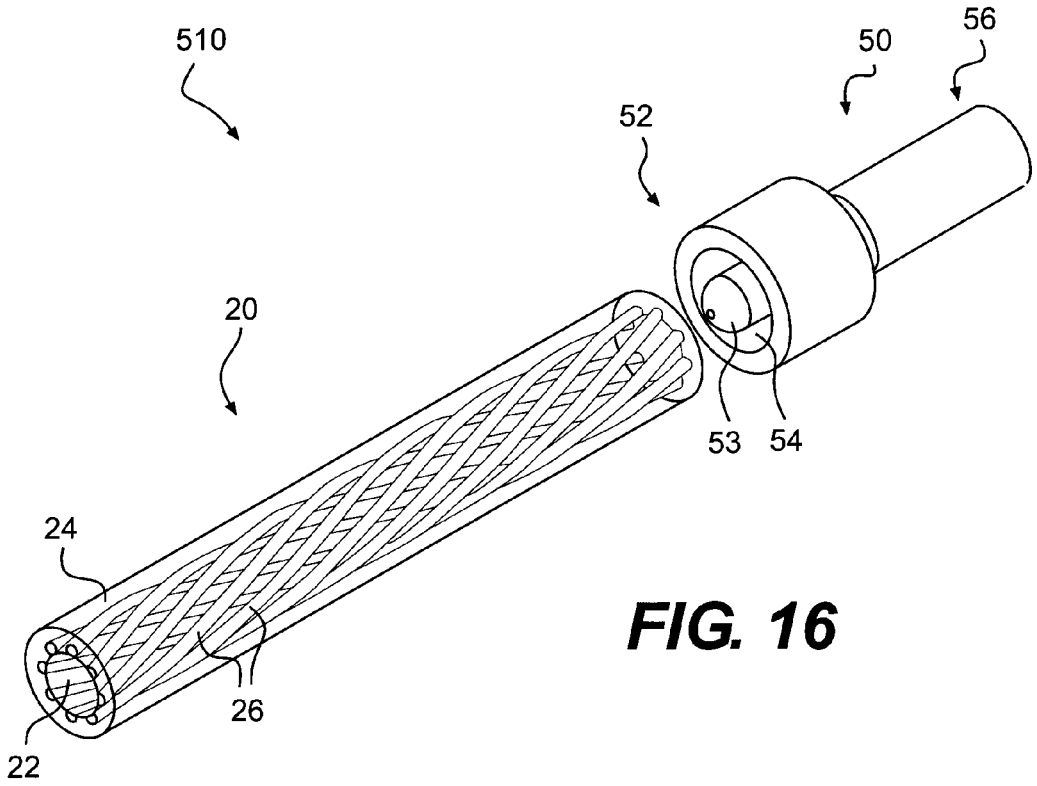
FIG. 16 is a perspective view of an end cap and an electrical contact, according to an exemplary embodiment.
Figure 17:
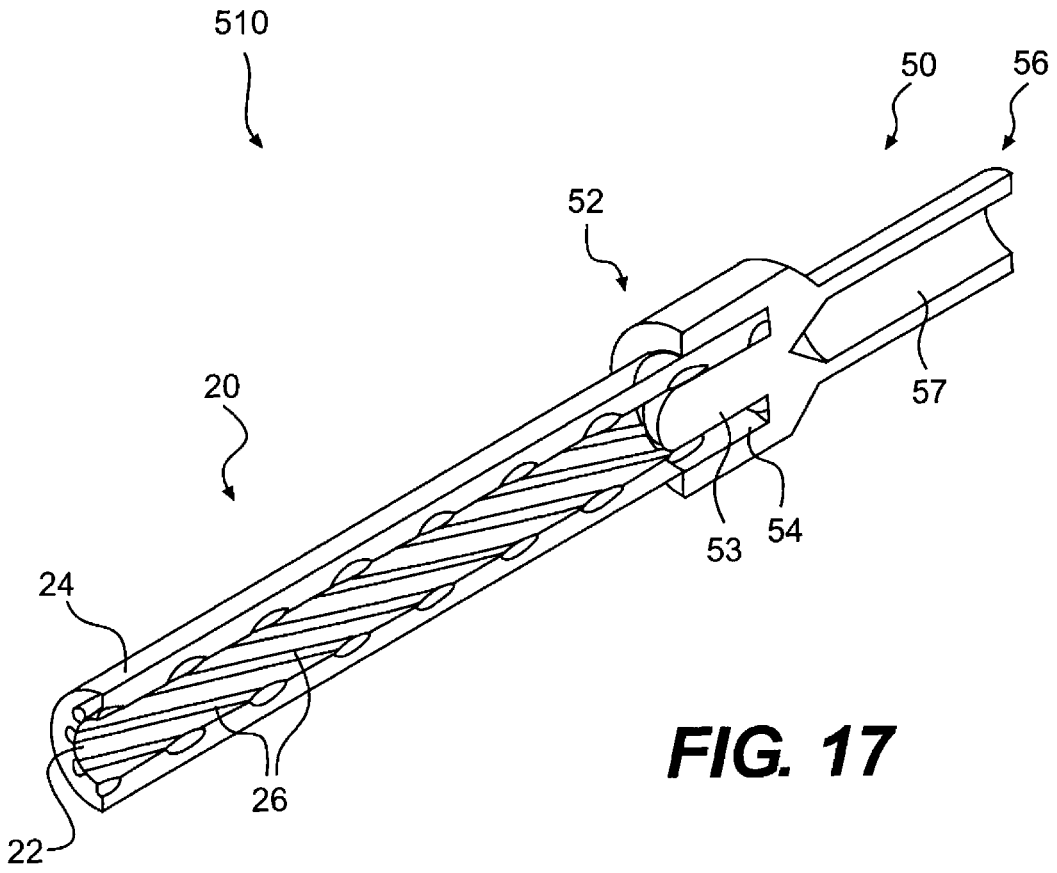
FIG. 17 is a cross-sectional perspective view of a contact assembly formed by attaching the end cap and the electrical contact of FIG. 16.
Figure 18:
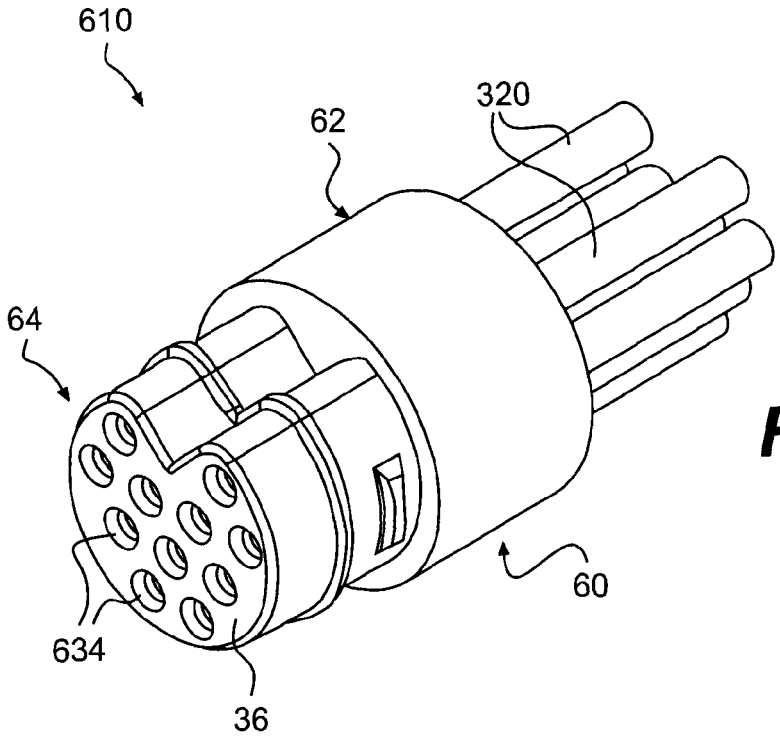
FIG. 18 is a perspective view of a first end of a plug connector, according to an exemplary embodiment.
Figure 19:
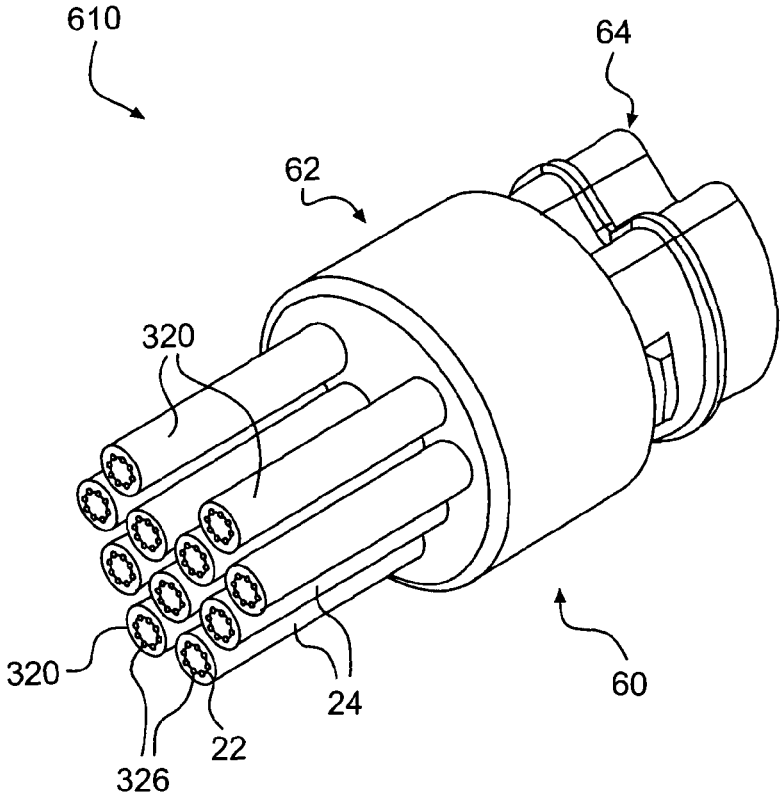
FIG. 19 is a perspective view of a second end of the plug connector of FIG. 18.

According to another embodiment, a contact assembly may be formed by connecting another type of termination device, such as an end cap 50, to the electrical contact 20. For example, FIGS. 16 and 17 show a contact assembly 510 formed by connecting the end cap 50 to the electrical contact 20, according to an exemplary embodiment. The end cap 50 may be formed at least partially from an electrically conductive material, such as any of the materials described above for forming the wires 26. The end cap 50 may include a first end 52 for connecting to the electrical contact 20. The first end 52 may include a protrusion 53 formed by an annular gap 54. As shown in FIG. 17, the annular gap 54 may be sized to receive an end of the electrical contact 20, and the protrusion 53 may be sized to be inserted into the channel 22 of the electrical contact 20. The end of the electrical contact 20 may be press fit into the annular gap 54 in the end cap 50, thereby simplifying the connection of the end cap 50 to the electrical contact 20. Accordingly, the contact assembly 510 may be configured to provide an electrical connection between the end cap 50 and the electrical contact 20.

The end cap 50 may also include a second end 56 configured to provide an interface for attaching to other connectors or components. As a result, the end cap 50 may provide an electrical connection between those connectors or components and the electrical contact 20. For example, the end cap 50 shown in FIGS. 16 and 17 may include a crimp barrel 57 or other opening or cavity sized for inserting, e.g., a stranded wire or other conductive structure, thereby establishing an electrical connection between the stranded wire and the electrical contact 20 via the end cap 50. Alternatively, the end cap 50 may include other types of attachment structures, such as a solder cup, a printed circuit board (PCB) tail, or other conventional attachment structures.

Figure 21:
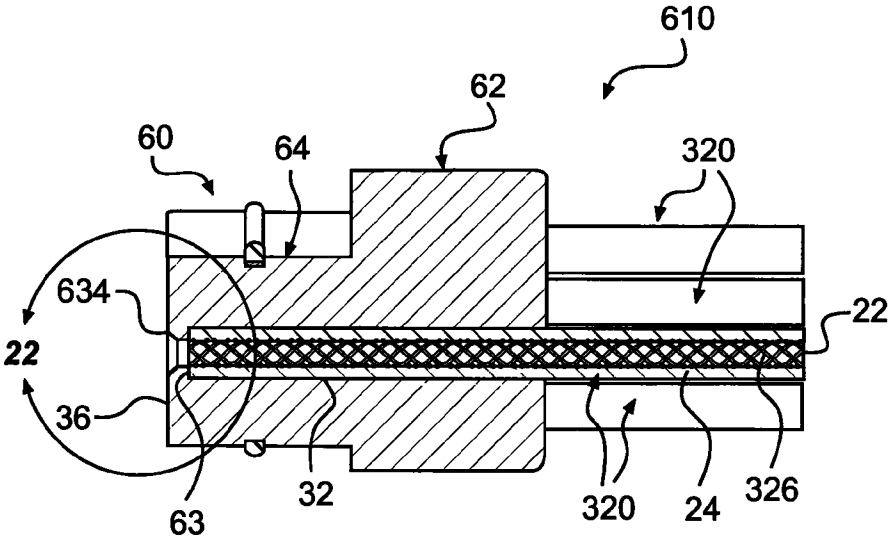
FIG. 21 is a cross-sectional side view of the plug connector of FIG. 18.
Figure 20:
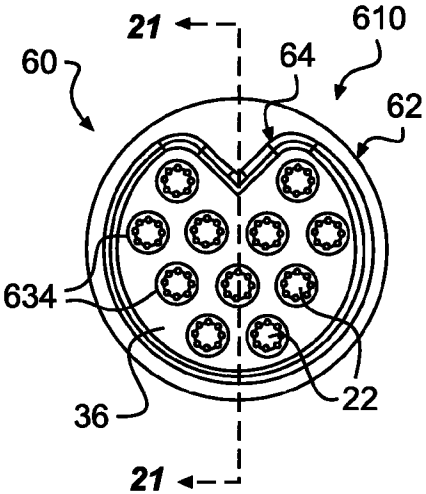
FIG. 20 is a front view of the plug connector of FIG. 18.

In certain embodiments, the electrical contacts and/or contact assemblies described above may be connected to a housing (e.g., housing 30 described in connection with FIGS. 1 and 2, or other housing) to form an electrical connector. For example, FIGS. 18-22 show an electrical plug (or socket) connector 610 formed by connecting a plurality of the electrical contacts 320 to a housing 60, according to another exemplary embodiment. The housing 60 may be generally similar to the housing 30 shown in FIGS. 1 and 2, and may also include a base portion 62 connected to a plug portion 64 for inserting into a receptacle portion 72 (FIGS. 23-30, 32, and 33) in an electrical receptacle connector 700 (FIGS. 28-30, 32, and 33), as will be described below. The housing 60 may include eleven cavities 32 extending through the axial length of the housing 60, e.g., through the base and plug portions 62, 64, as shown in FIG. 21. In the embodiment shown in FIGS. 18-22, the housing 60 may include eleven cavities 32, but alternatively, fewer or more than eleven cavities 32 may be provided, e.g., depending on the application.

Figure 22:
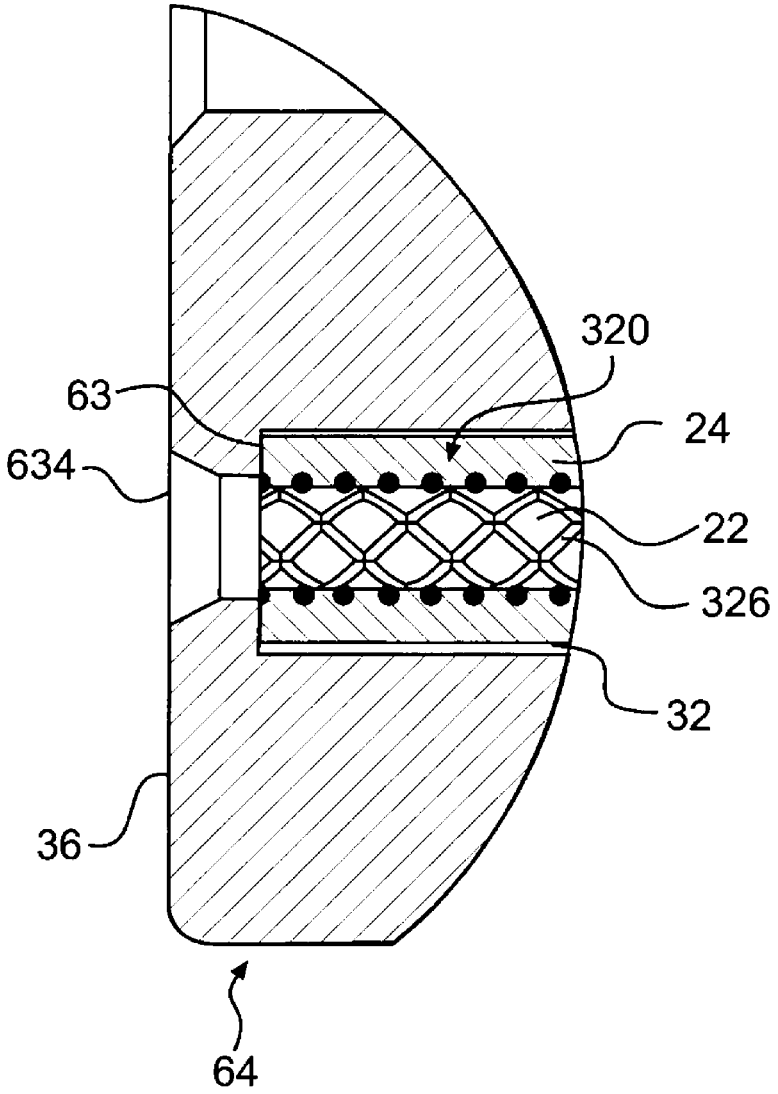
FIG. 22 is a partial cross-sectional side view of the plug connector of FIG. 18.
Figure 23:
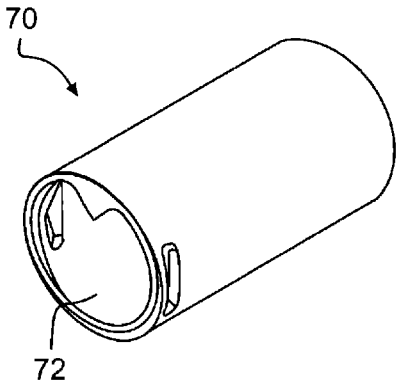
FIG. 23 is a perspective view of a first end of a housing for a receptacle connector, according to another exemplary embodiment.
Figure 24:
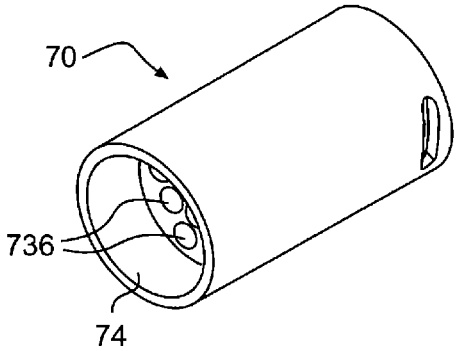
FIG. 24 is a perspective view of a second end of the housing of FIG. 23.
Figure 25:
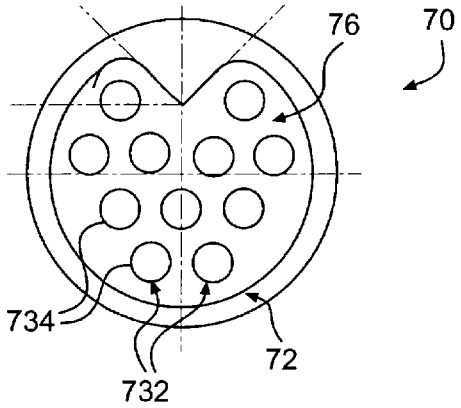
FIG. 25 is a front view of the housing of FIG. 23.
Figure 26:
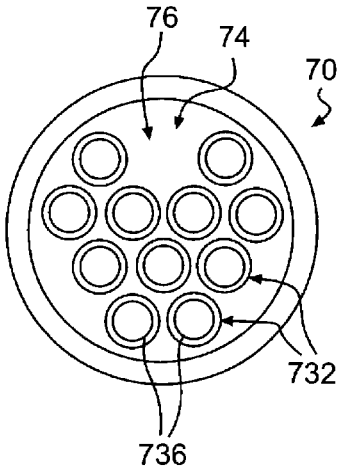
FIG. 26 is a rear view of the housing of FIG. 23.
Figure 27:
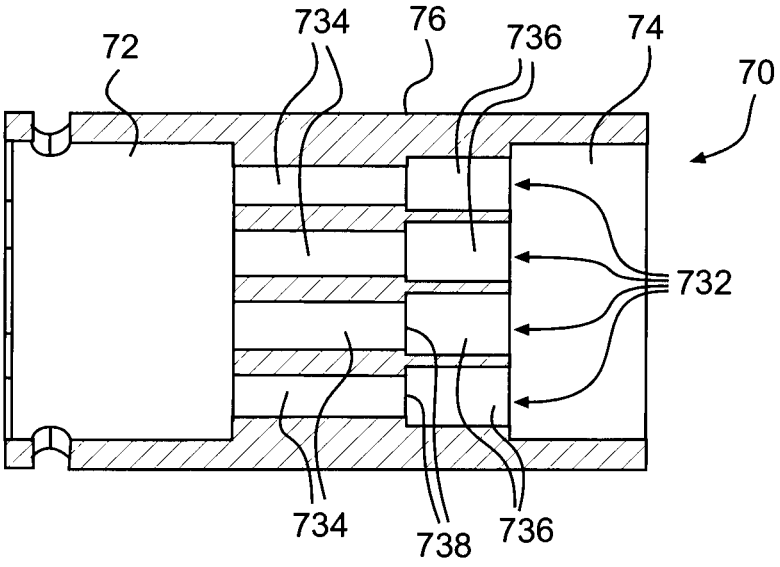
FIG. 27 is a cross-sectional side view of the housing of FIG. 23.

The cavities 32 may form openings 634 in the face 36 of the plug portion 64 of the housing 60. As shown in FIGS. 21 and 22, the openings 634 may be slightly narrower than a remaining portion of the cavities 32 such that a surface 63 may be formed against which the ends of the electrical contacts 320 may abut when inserted into the cavities 32 in the housing 60. Also, as shown in FIGS. 21 and 22, the openings 634 may include chamfers that widen the openings 634 towards the face 36.

The housing 60 may be formed of polyetherimide (PEI), other polymers, or other similar materials. In an embodiment, the diameter of the cavities 32 (excluding the openings 634) may be approximately 0.68 to 0.70 millimeters (0.027 to 0.028 inches) and the diameter of the openings 634 may be approximately 0.36 millimeters (0.014 inches). The housing 60 may be approximately 4.9 millimeters (0.193 inches) long, the plug portion 64 may have an outer diameter of approximately 3.27 millimeters (0.129 inches), and the base portion 62 may have an outer diameter of approximately 3.89 millimeters (0.153 inches).

As shown in FIGS. 21 and 22, a plurality of the electrical contacts 320 may be inserted through the respective cavities 32 in the housing 60. The electrical contacts 320 may be permanently attached to the inner surfaces of the respective cavities 32, e.g., using an adhesive. Alternatively, the electrical contacts 320 may be attached to the inner surfaces of the respective cavities 32, e.g., using a cable connector or cable gland, such as a threaded connection, such that the electrical contacts 320 may be removed.

FIGS. 23-27 show a housing 70 of the receptacle connector 700 (FIGS. 28-30, 32, and 33) for connecting to the plug connector 610 shown in FIGS. 18-22, according to an exemplary embodiment. The housing 70 may include a first receptacle portion 72 at a first end and a second receptacle portion 74 at the second, opposite end. The first and second receptacle portions 72, 74 are joined by an intermediate portion 76 of the housing 70. The intermediate portion 76 includes one or more cavities 732 extending through the axial length of the intermediate portion 76.

Figure 28:
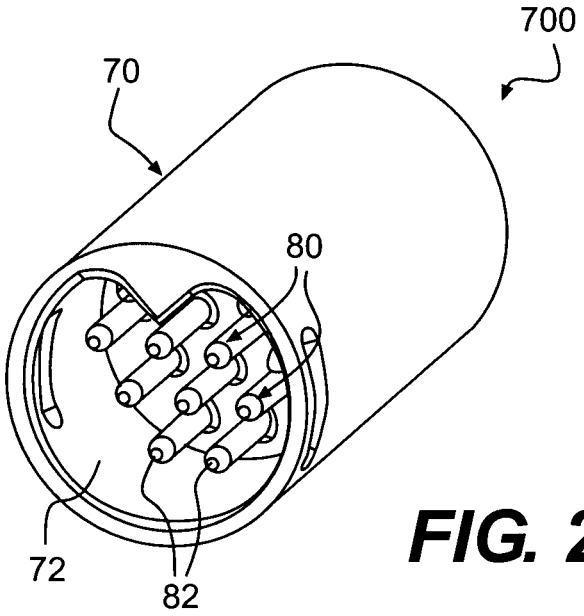
FIG. 28 is a perspective view of a receptacle connector including the housing of FIG. 23 and a plurality of pins, according to an exemplary embodiment.
Figure 29:
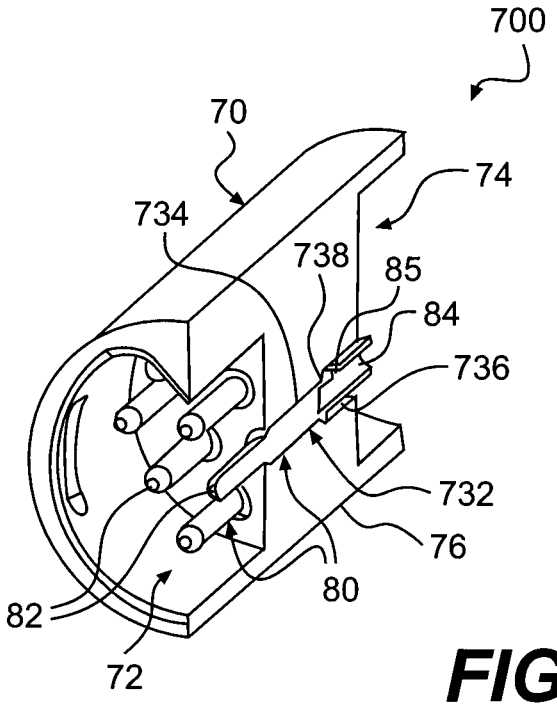
FIG. 29 is a cross-sectional perspective view of the receptacle connector of FIG. 28.
Figure 30:
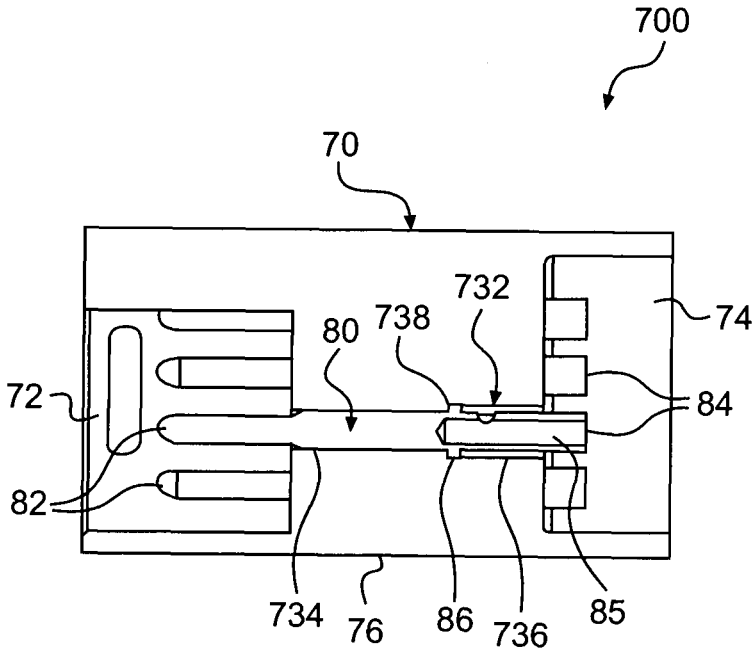
FIG. 30 is a cross-sectional side view of the receptacle connector of FIG. 28.

FIGS. 28-30 show the receptacle connector 700 for connecting to the plug connector 610 shown in FIGS. 18-22, according to an exemplary embodiment. The receptacle connector 700 may include the housing 70 shown in FIGS. 23-27. In the exemplary embodiment, the housing 70 may include eleven cavities 732 (corresponding to the eleven cavities 32 in the housing 60 of the plug connector 610), but alternatively, fewer or more than eleven cavities 732 may be provided, e.g., depending on the application.

Figure 31:
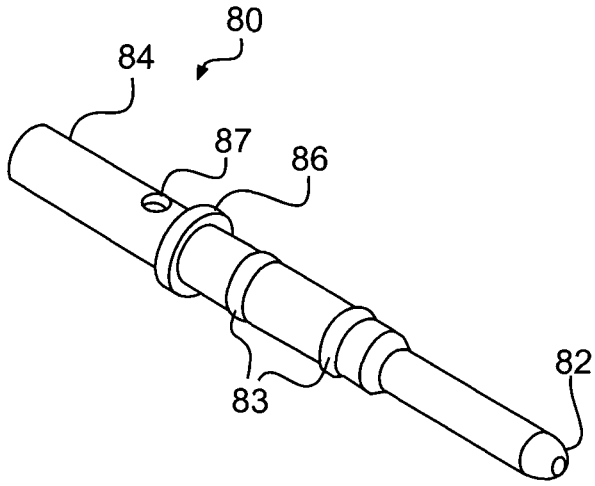
FIG. 31 is a perspective view of the pin of FIG. 28.

The cavities 732 in the housing 70 may be sized to each receive a pin 80. FIG. 31 shows the pin 80, according to an exemplary embodiment. The pin 80 may include a tip portion 82 and a tail portion 84, which may include a flange or shoulder 86. The tip portion 82 may include a bullet nose serving as a mating lead-in. Optionally, the pin 80 may also include one or more press-fit barbs 83 to assist in retention of the pin 80 when the pin 80 is press fit into the housing 70. The tail portion 84 may include a crimp barrel 85, as shown in FIGS. 29 and 30, which may receive a stranded wire (not shown) and may be crimped to connect to the wire. The tail portion 84 may also include a hole 87, as shown in FIG. 31, to facilitate plating.

Each cavity 732 in the housing 70 may include a first portion 734 configured to receive the tip portion 82 of the corresponding pin 80 and a second portion 736 configured to receive the tail portion 84 of the corresponding pin 80. The second portions 736 may be slightly wider than the first portions 734 such that a surface 738 may be formed against which the flanges 86 of the pins 80 may abut when inserted into the cavities 732 in the housing 70, as shown in FIGS. 29 and 30. As a result, the flanges 86 may serve as positive stops for the pins 80 during installation of the pins 80 in the housing 70. Also, when the pins 80 are inserted into the cavities 732 in the housing 70, the tip portions 82 of the pins 80 may extend into the first receptacle portion 72 of the housing 70 and the tail portions 84 of the pins 80 may extend into the second receptacle portion 74 of the housing 70, as shown in FIGS. 29 and 30.

In an exemplary embodiment, the pins 80 may be attached to the housing 70 by potting (filling) or over-molding the end of the housing 70 that includes the second receptacle portion 74 after the wires (not shown) are connected to the tail portions 84 of the pins 80, e.g., via the crimp barrels 85. Alternatively, the pins 80 may be permanently attached to the inner surfaces of the respective first portions 734 and/or second portions 736 of the cavities 732, e.g., using an adhesive. As another alternative, the pins 80 may be attached to the inner surfaces of the cavities 732, e.g., using a cable connector or cable gland, such as a threaded connection, such that the pins 80 may be removed.

Figure 32:
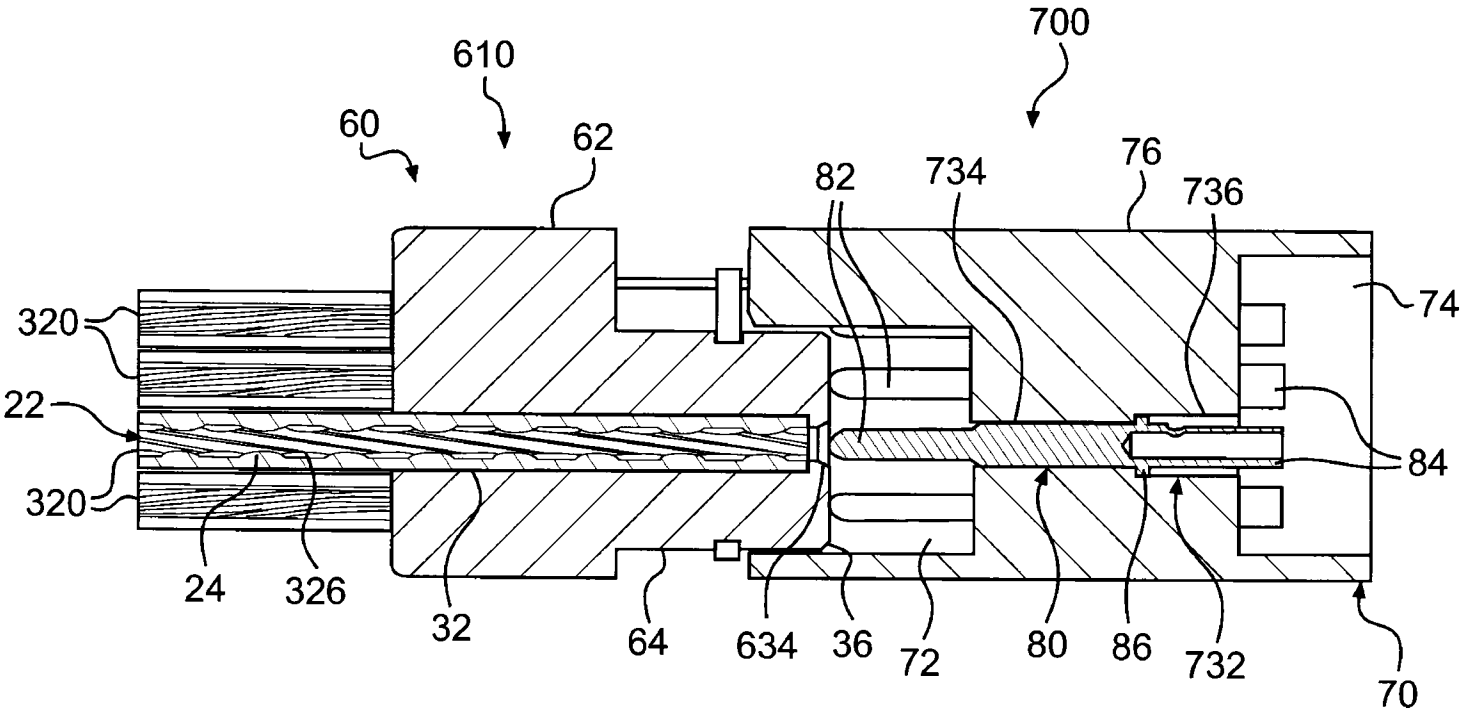
FIG. 32 is a cross-sectional side view of the plug connector of FIG. 18 and the receptacle connector of FIG. 28.
Figure 33:
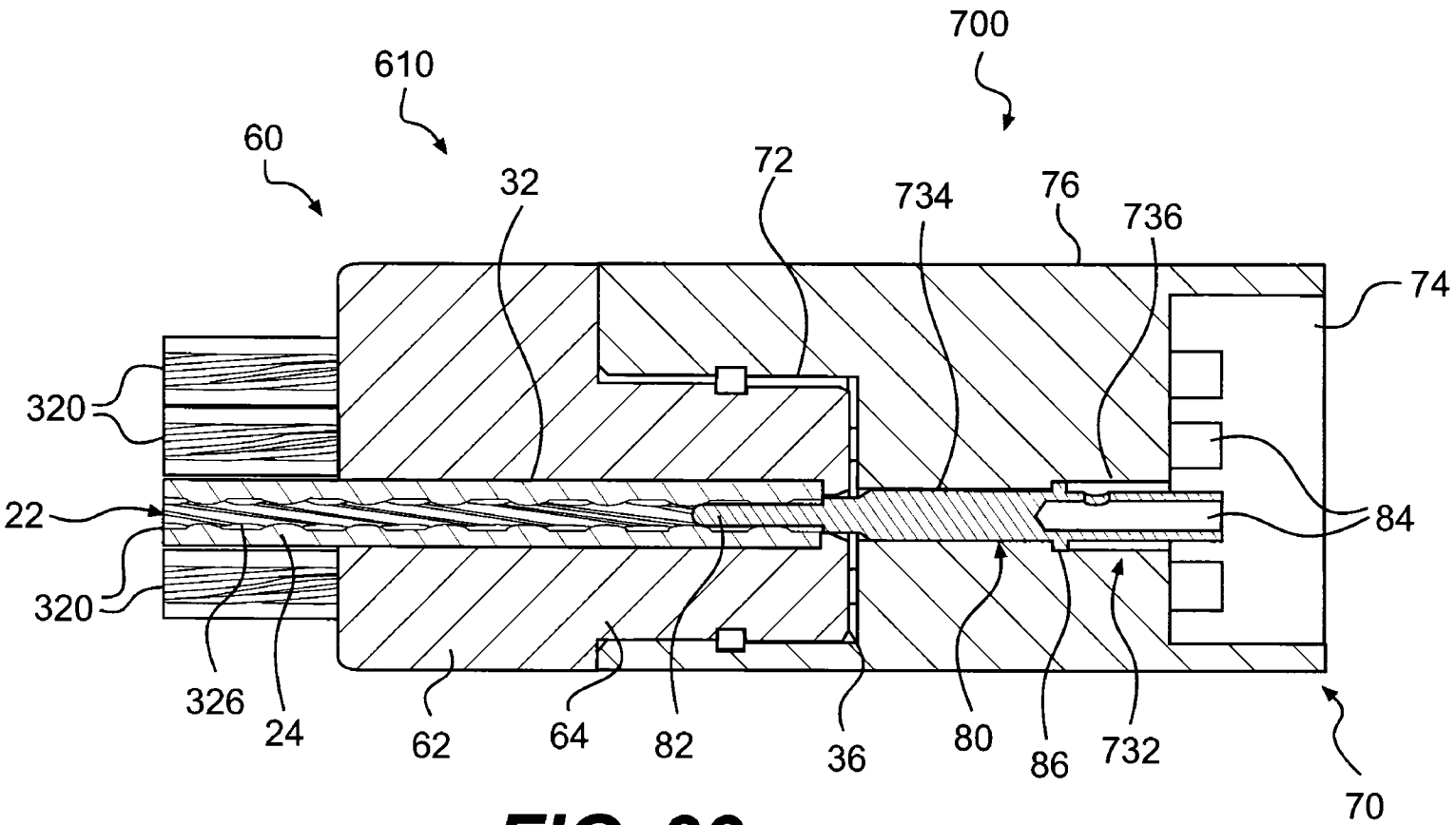
FIG. 33 is a cross-sectional side view of the plug connector of FIG. 18 mated to the receptacle connector of FIG. 28.

FIGS. 32 and 33 show the plug connector 610 connected to the receptacle connector 700, according to an exemplary embodiment. When the receptacle connector 700 is connected to the plug connector 610, the plug portion 64 may be inserted into the receptacle portion 72 of the receptacle connector 700 and the pins 80 in the receptacle connector 700 may be inserted through the openings 634 in the face 36 of the housing 60 of the plug connector 610. The pins 80 may be received within the channels 22 in the electrical contacts 320 disposed within the cavities 32 in the housing 60 of the plug connector 610. When the pins 80 are inserted into the channels 22 in the electrical contacts 320, an electrical connection is formed between the wires 326 in the electrical contacts 320 and the pins 80.

As shown in FIGS. 32 and 33, when the electrical contacts 320 are inserted into the housing 60, the fit between the electrical contacts 320 and the housing 60 within the cavities 32 may leave little room for radial expansion of the electrical contacts 320 when the pins 80 are inserted into the electrical contacts 320. Thus, the electrical contacts 320 may be compressed against the surface of the cavities 32 in the housing 60, thereby providing radial pressure or force on the pins 80 such that the wires 326 in the electrical contacts 320 may be maintained in contact with the pins 80 (e.g., to prevent the pins 80 from inadvertently slipping out of the channels 22 as well as to provide sufficient normal force to ensure an uninterrupted connection having low resistance).

In an embodiment, the first portions 734 of the cavities 732 may have a diameter of approximately 0.48 millimeters (0.0189 inches) and a length of approximately 1.87 millimeters (0.074 inches), the second portions 736 of the cavities 732 may have a diameter of approximately 0.66 millimeters (0.026 inches), the total length of the cavities 732 may be approximately 3.00 millimeters (0.118 inches), the housing 70 may have an outer diameter of approximately 3.89 millimeters (0.153 inches) and a length of approximately 7.00 millimeters (0.276 inches), the first receptacle portion 72 may have an inner diameter of approximately 3.33 millimeters (0.131 inches) and length of approximately 2.50 millimeters (0.098 inches), and the second receptacle portion 74 may have an inner diameter of approximately 3.33 millimeters (0.131 inches). The housing 70 may be formed of polyetherimide (PEI), other polymers, or other similar materials.

Various types of termination devices, housings, carrier devices, and other components for connecting to the electrical contacts 20 are described above, e.g., the housings 30, 60, the conductors 40, the end caps 50, the pins 80, etc., to form a contact assembly and/or an electrical connector. The termination devices, housings, carrier devices, and other components may be provided interchangeably. One type of termination device, housing, carrier device, or other component may be attached to one end of the electrical contact(s) 20 and another type of termination device, housing, carrier device, or other component may be attached to the opposite end of the electrical contact(s) 20.

Figure 34:
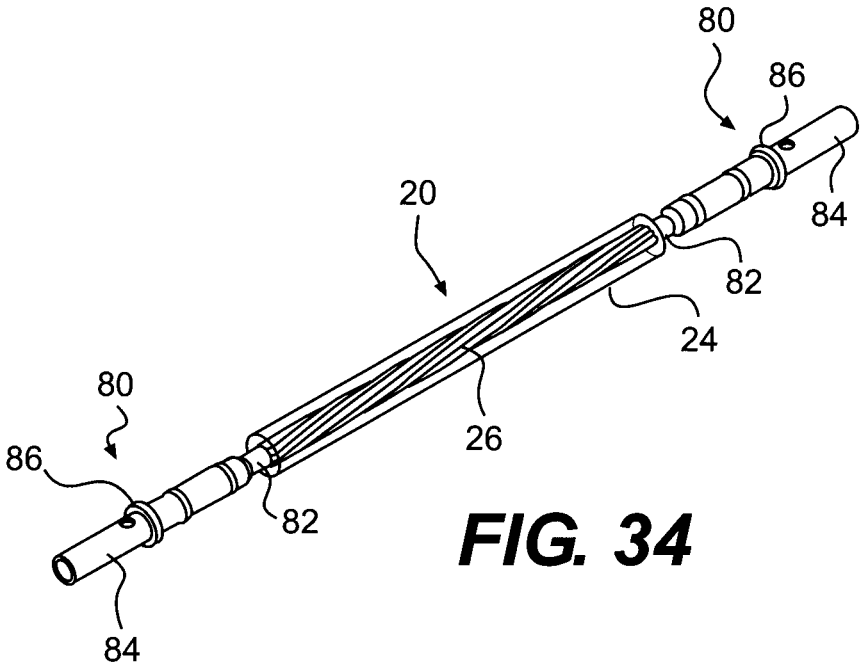
FIG. 34 is a perspective view of a contact assembly including the electrical contact of FIGS. 1-5 connected to two of the pins of FIG. 31.

FIG. 34 shows the electrical contact 20 for directly connecting to two of the pins 80 of FIG. 31, e.g., without including a separate termination device, housing, carrier device, or other component. The respective pins 80 may be received within the channel 22 of the electrical contact 20 at opposite ends of the electrical contact 20 to form a contact assembly. As a result, the electrical contact 20 may serve as a flexible socket for the pins 80. The pins 80 may have a greater outer diameter (or other dimension) than the inner diameter (or other dimension) of the wire(s) 26 and/or the tubular body 24 forming the channel 22. The elasticity of the electrical contact 20 (e.g., the tubular body 24 and/or the wire(s) 26) may limit the radial expansion of the electrical contact 20 when the pins 80 are inserted into the electrical contact 20. Thus, the electrical contact 20 may provide a compressive radial pressure or force on the pins 80 such that the wire(s) 26 in the electrical contact 20 may be maintained in contact with the pins 80 (e.g., to prevent the pins 80 from inadvertently slipping out of the channel 22 as well as to provide sufficient normal force to ensure an uninterrupted connection having low resistance). Alternatively, the ends of the electrical contact 20 may receive other types of conductive structures other than the pins 80 for electrical connections between the electrical contact 20 and the conductive structures.

Figure 35:
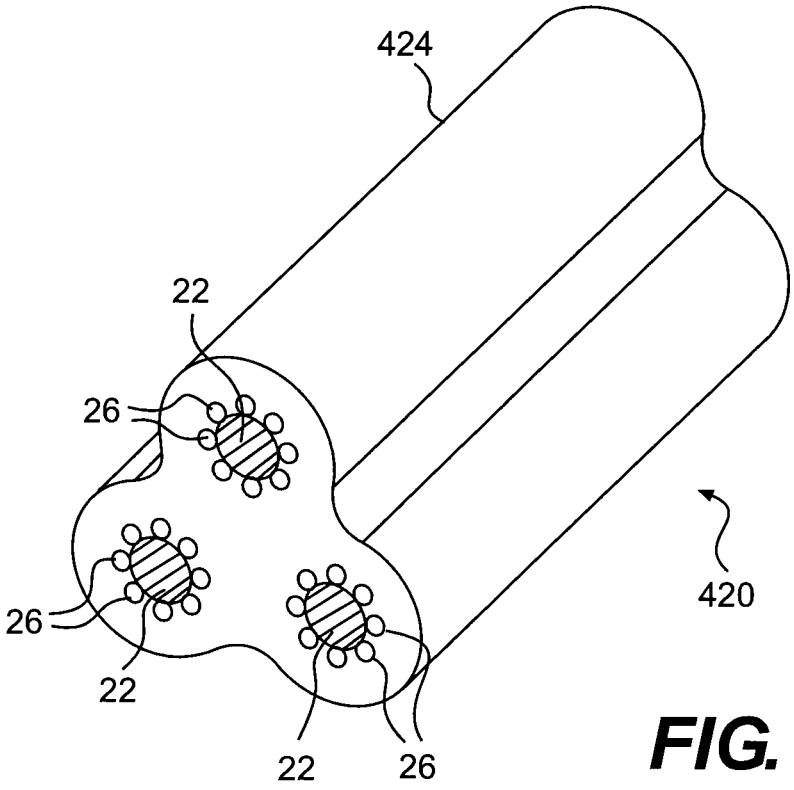
FIG. 35 is a perspective view of a multi-lumen electrical contact, according to an exemplary embodiment.

The electrical contact 20 may be formed in various configurations. For example, the electrical contact 20 may include more than one channel 22 such that the electrical contact 20 is formed with a multi-lumen configuration. FIG. 35 shows an electrical contact 420 including a seamless and continuous tubular body 424 with wires 26 embedded into the tubular body 424 to form multiple channels 22 extending substantially longitudinally through the tubular body 424. In the exemplary embodiment shown in FIG. 35, the electrical contact 420 includes three channels 22, but alternatively, fewer or more than three channels 22 may be provided, e.g., depending on the application. When forming the electrical contact 420, the tubular body 424 may be extruded or otherwise formed over the wires 26 of the multiple channels 22 simultaneously.

Figure 36:
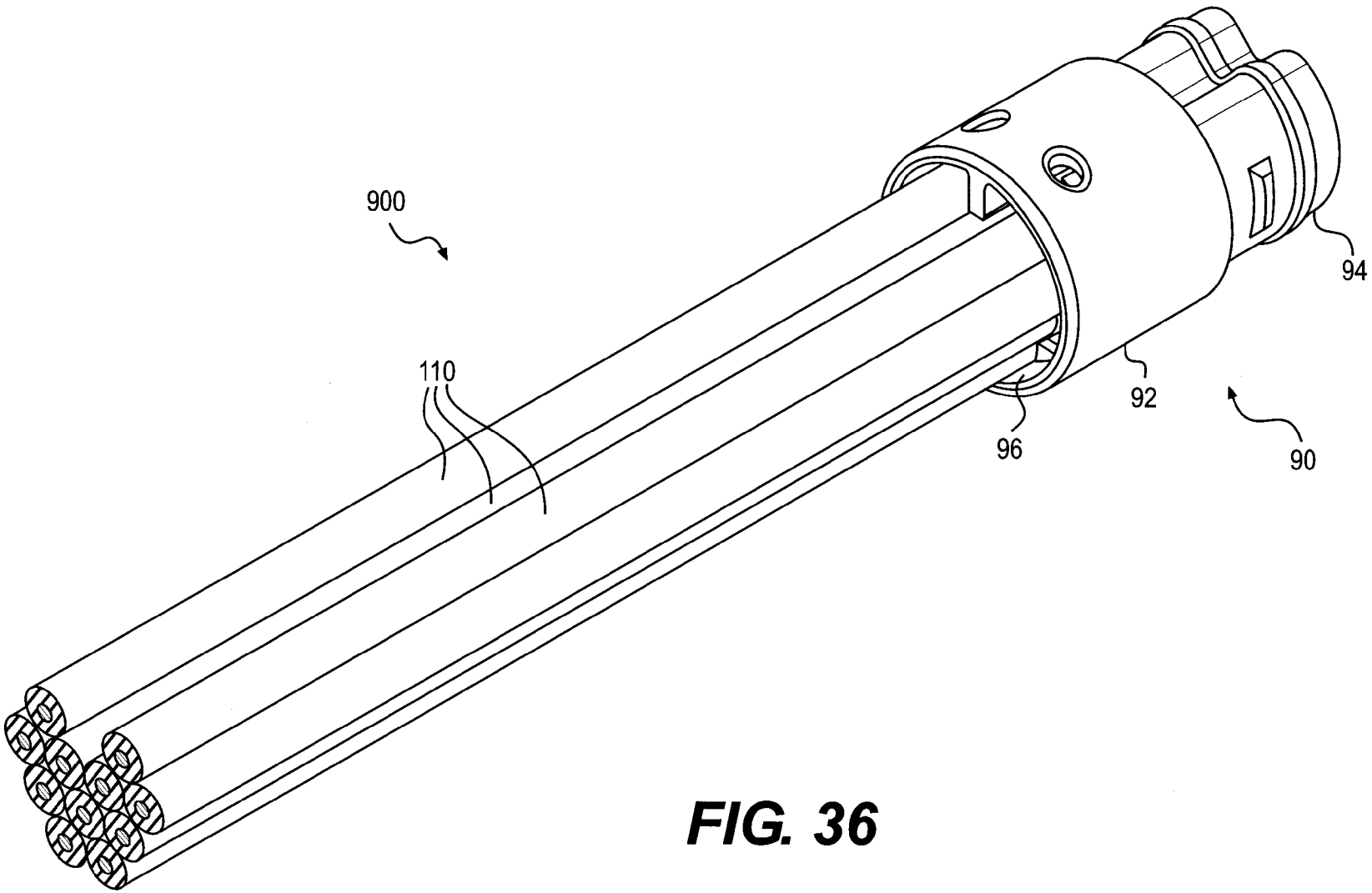
FIG. 36 is a perspective view of a plug connector, according to an exemplary embodiment.
Figure 39:
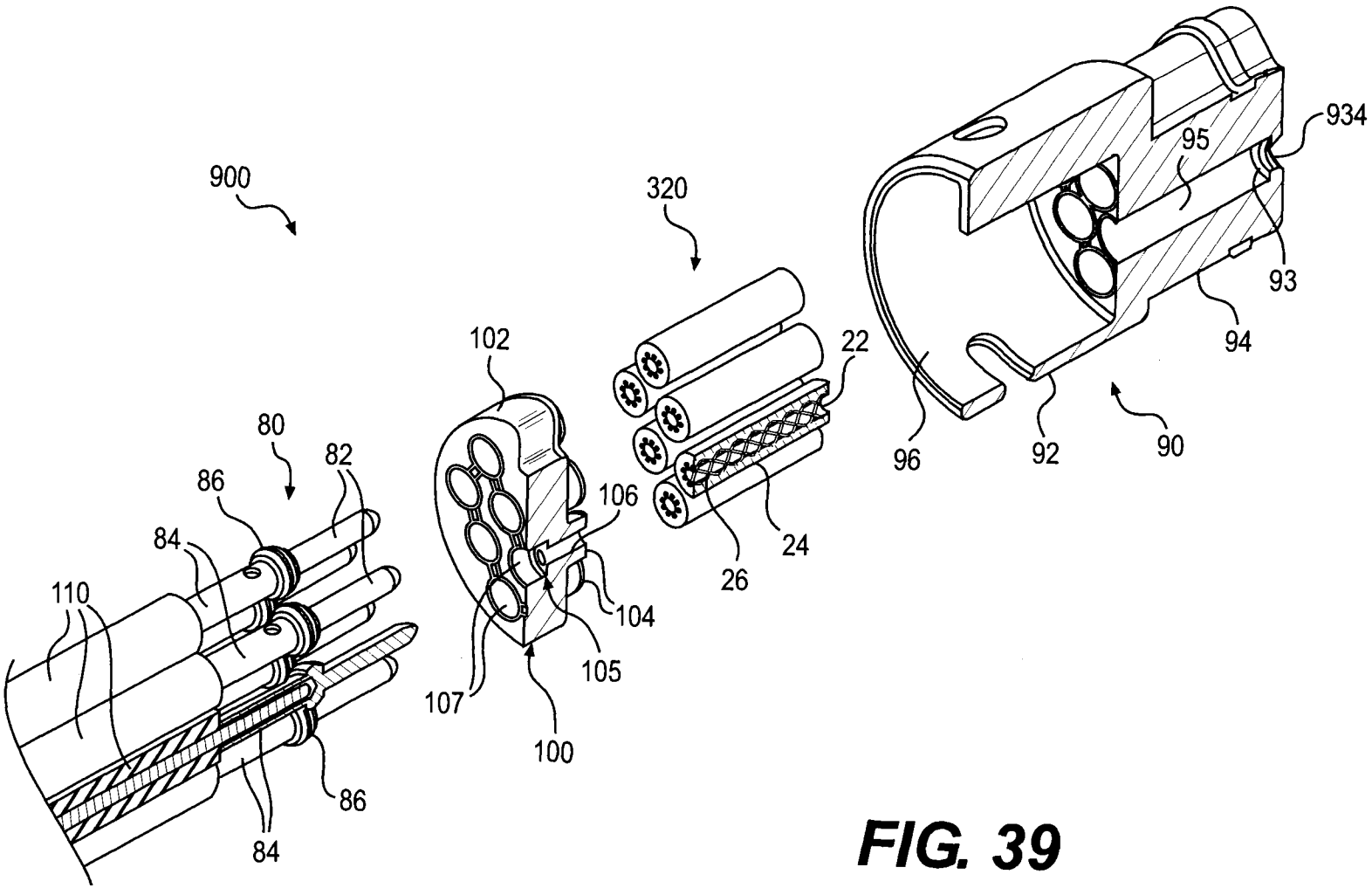
FIG. 39 is a cross-sectional exploded view of the plug connector of FIG. 36.
Figure 40:
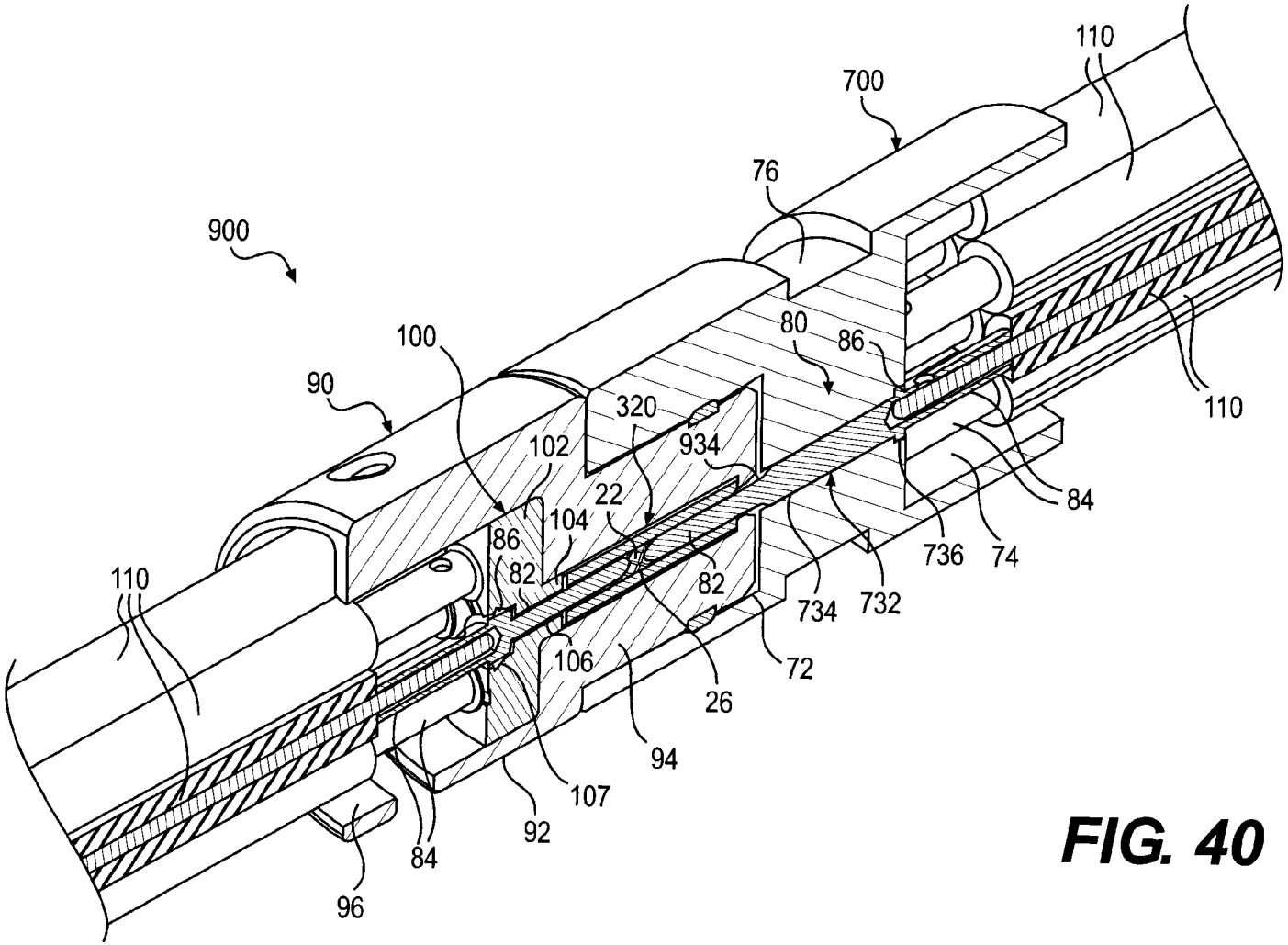
FIG. 40 is a cross-sectional perspective view of the plug connector of FIG. 36 mated to a receptacle connector.

FIGS. 36-40 show another embodiment of an electrical plug (or socket) connector 900 formed by inserting a plurality of the electrical contacts 320 into a housing 90. As shown in FIG. 36, the housing 90 may include a base portion 92 connected to a plug portion 94 for insertion into the receptacle portion 72 in the electrical receptacle connector 700 (FIGS. 23-30, 32, and 33), as shown in FIG. 40 and as will be described below.

Figure 37:
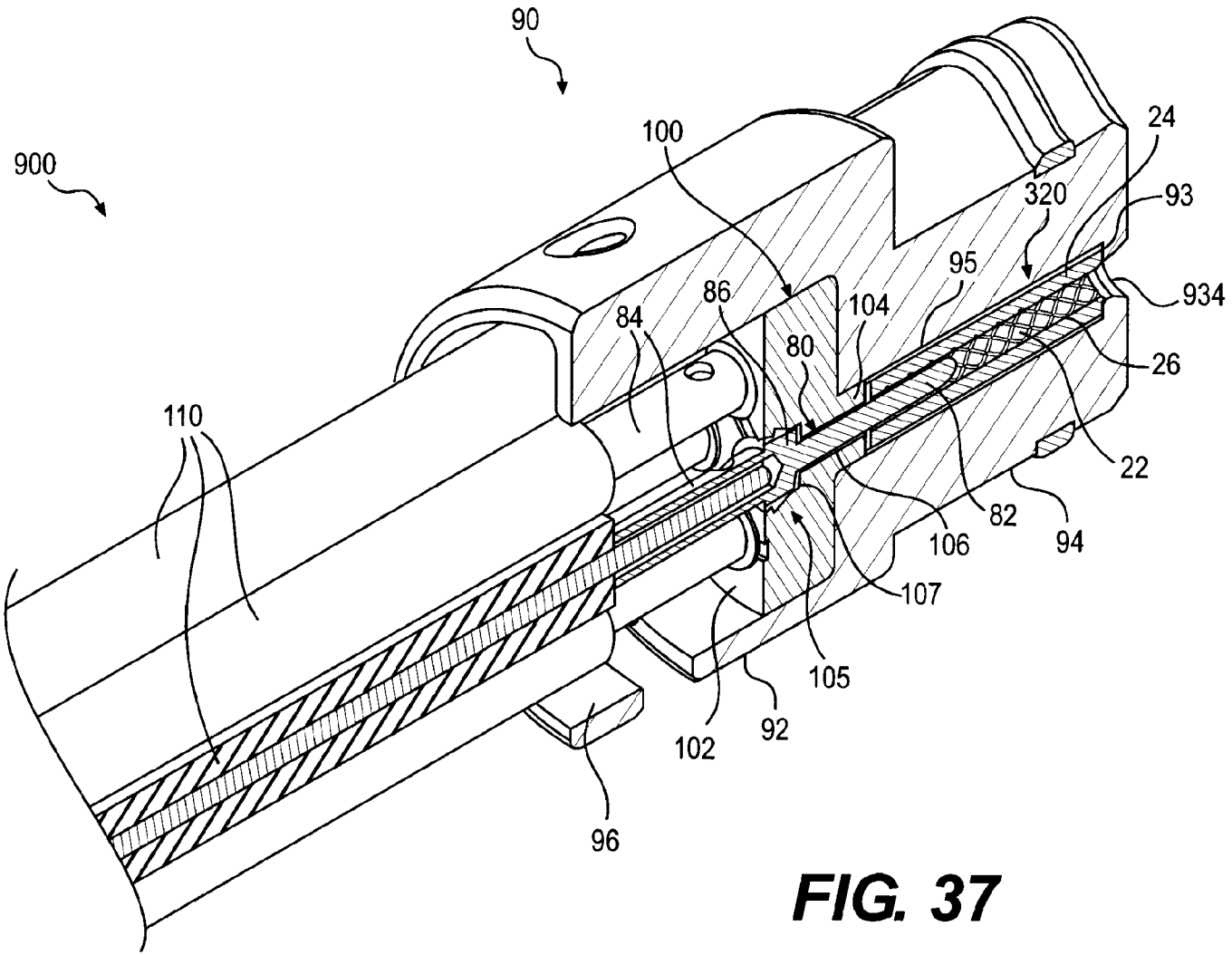
FIG. 37 is a cross-sectional perspective view of the plug connector of FIG. 36.
Figure 38:
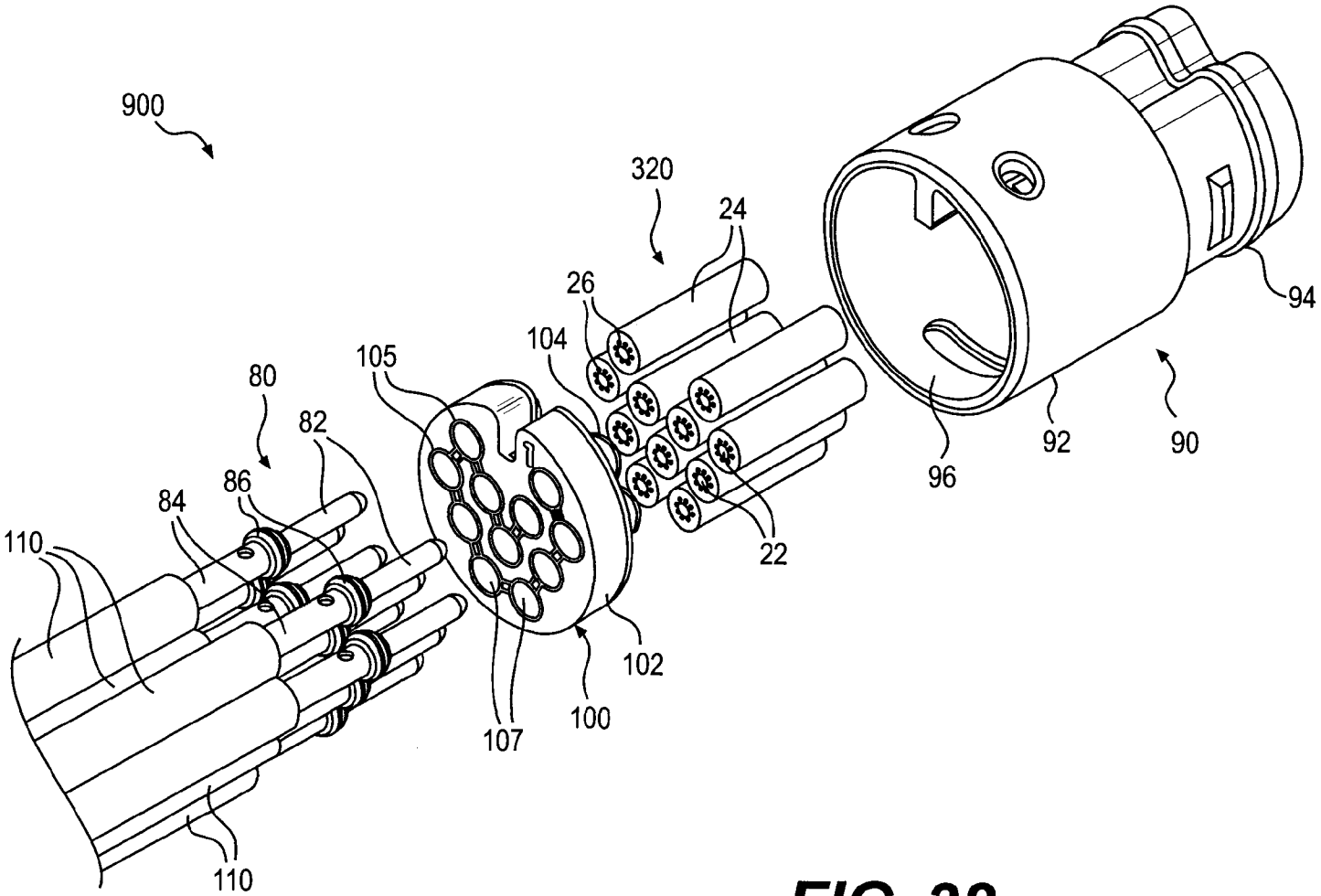
FIG. 38 is an exploded view of the plug connector of FIG. 36.

As shown in FIG. 37, the housing 90 may include eleven cavities 95 extending through at least a portion of the axial length of the housing 90, e.g., through at least a portion of the base portion 92 and at least a portion of the plug portion 94 as shown in FIG. 37, or alternatively through at least a portion of the plug portion 94 only. In the embodiment shown in FIGS.

36-40, eleven cavities 95 may be provided, but alternatively, fewer or more than eleven cavities 95 may be provided, e.g., depending on the application. The plurality of cavities 95 connect to an opening 96 that extends from the face of the base portion 92 of the housing 90 and at least partially through the base portion 92 as shown in FIG. 37. Alternatively, the opening 96 may extend through at least a portion of the base portion 92 and at least a portion of the plug portion 94.

The cavities 95 may form plug-side openings 934 in the face of the plug portion 94 of the housing 90. As shown in FIGS. 37 and 39, the plug-side openings 934 may be slightly narrower than a remaining portion of the cavities 95 such that a surface 93 may be formed against which the ends of the electrical contacts 320 may abut when inserted into the cavities 95 in the housing 90. The plug-side openings 934 may include chamfers that widen the plug-side openings 934 towards the face of the plug portion 94 of the housing 90.

The housing 90 may be formed of similar materials as described above in connection with the other housings and carrier devices. Also, the dimensions of the housing 90, the plug portion 94, the base portion 92, the cavities 95, and/or the openings 934 may be similar to the dimensions described above in connection with the similar features of other housings and carrier devices.

As shown in FIGS. 37-40, a plurality of the electrical contacts 320 (e.g., eleven electrical contacts 320) may be inserted through the opening 96 and into the respective cavities 95 in the housing 90. The electrical contacts 320 may be permanently or removably attached to the inner surfaces of the respective cavities 95, e.g., using an adhesive, a threaded connection, etc.

A gasket 100 may also be inserted into the opening 96 of the housing 90. The gasket 100 may be formed of, for example, a rubber or elastomeric material or other material used for forming seals, and may be attached to the housing 90, e.g., using an adhesive. The gasket 100 may include a base portion 102 and a plurality of protrusions 104 (e.g., eleven protrusions 104 or other number corresponding to the number of cavities 95 in the housing 90) extending from the base portion 102. The protrusions 104 are positioned on the base portion 102 so that, when the gasket 100 is inserted into the opening 96 of the housing 90, the protrusions 104 may be inserted at least partially into the respective cavities 95. A face of the base portion 102 of the gasket 100 from which the protrusions 104 extend may be positioned flush against a corresponding inner surface of the housing 90 defining the opening 96, as shown in FIGS. 37 and 40.

In the exemplary embodiment, the gasket 100 may include a plurality of cavities 105 (e.g., eleven cavities 105 or other number corresponding to the number of cavities 95 in the housing 90). Each cavity 105 in the gasket 100 may be sized to receive one of the pins 80 (FIG. 31) or other type of pin, as shown in FIGS. 37-40. Each cavity 105 may include a first portion 106 configured to receive a portion of the tip portion 82 of the corresponding pin 80 and a second portion 107 configured to receive at least a portion of the tail portion 84 of the corresponding pin 80. The second portions 107 may be slightly wider than the first portions 106 such that a surface may be formed against which the flanges 86 of the pins 80 may abut when inserted into the cavities 105 in the gasket 100, as shown in FIGS. 37, 39, and 40. As a result, the flanges 86 may serve as positive stops for the pins 80 during installation of the pins 80 in the gasket 100.

When the pins 80 are inserted into the cavities 105 in the gasket 100, the tip portions 82 of the pins 80 may extend into the channels 22 of the respective electrical contacts 320 positioned in the cavities 95 in the housing 90. The tip portions 82 may be press fit into the channels 22 of the respective electrical contacts 320.

Also, when the pins 80 are inserted into the cavities 105 in the gasket 100, the tail portions 84 of the pins 80 may extend into the opening 96 of the housing 90, as shown in FIGS. 37 and 40. Insulated wires 110 or other conductive structures may be connected to the tail portions 84 of the respective pins 80. As shown in FIGS. 37 and 40, a wire portion of the insulated wires 110 may be connected to the respective tail portions 84 of the pins 80 (e.g., the crimp barrels 85). Alternatively, the tail portions 84 of the pins 80 may be connected to other types of connection structures, such as PCB terminations or tails, etc.

Assembly of the electrical plug connector 900 may include the steps of inserting the electrical contacts 320 into the respective cavities 95 of the housing 90 and then pressing the gasket 100 into the opening 96 of the housing 90. The gasket 100 may be pressed into the opening 96 until the protrusions 104 are inserted at least partially into the respective cavities 95 to push the electrical contacts 320 until the electrical contacts 320 contact the surface 93. Then, the pins 80 (e.g., separate or connected to the insulated wires 110, PCB tails, etc.) may be pressed into the respective cavities 105 in the gasket 100. The flanges 86 of the pins 80 may serve as retention barbs to lock the pins 80 in place with respect to the gasket 100 and to lock the gasket 100 in place with respect to the housing 90 by expanding out the gasket 100 when the flanges 86 are inserted into the gasket 100. The expansion of the gasket 100 assists in providing the press fit connection of the gasket 100 to the housing 90. Also, the press fit connection of the pins 80 to the gasket 100 and the press fit connection of the gasket 100 to the housing 90 may serve to lock the pins 80 and the gasket 100 in place with respect to the housing 90. Optionally, epoxy (or other thermosetting polymer or other material), potting compound, and/or over-molding may be applied to the assembled components to hold one or more of the components of the assembled electrical plug connector 900 together, to provide strain relief for the wires 110, to improve ergonomics, to improve appearance, etc.

The gasket 100 may serve as a seal to prevent water and other undesirable elements outside the housing 90 from reaching the electrical contacts 320. For example, the gasket 100 may be dimensioned such that the outer peripheral surface of the gasket 100 tightly seals against the inner surface of the opening 96 of the housing 90 and against an outer surface of the pins 80. The gasket 100 may be compressed when inserted into the opening 96 of the housing 90 in order to form the seal (e.g., like a stopper or plug). As a result, the gasket 100 may press against the pins 80 and the housing 90 to form the seal between the pins 80 and the housing 90.

In the embodiment shown in FIGS. 36-40, the electrical contacts 320 are relatively shorter, and may be contained substantially or entirely within the housing 90. In the exemplary embodiment, the electrical contacts 320 may be contained substantially or entirely within the cavities 95 in the housing 90, and the gasket 100 may position and retain the electrical contacts 320 inside the cavities 95 of the housing 90. The gasket 100 may ensure that the electrical contacts 320 are pushed forward in the housing 90, e.g., to contact the surface 93 (FIG. 39) of the housing 90. As a result, a more stable and secure electrical connection may be obtained, depending on the application.

FIG. 40 shows the plug connector 900 connected to the receptacle connector 700 of FIGS. 23-30, 32, and 33, according to an exemplary embodiment. When the receptacle connector 700 is connected to the plug connector 900, the plug portion 94 may be inserted into the receptacle portion 72 of the receptacle connector 700 and the pins 80 in the receptacle connector 700 may be inserted through the openings 934 in the face of the housing 90 of the plug connector 900. The pins 80 in the receptacle connector 700 may be received within the channels 22 in the electrical contacts 320 disposed within the cavities 95 in the housing 90 of the plug connector 900. When the pins 80 in the receptacle connector 700 are inserted into the channels 22 in the electrical contacts 320, an electrical connection is formed between the wires 326 in the electrical contacts 320, the pins 80 in the plug connector 900, and the pins 80 in the receptacle connector 700. As a result, an electrical connection is also formed between the insulated wires 110 connected to the pins 80 of the plug connector 900 and the insulated wires 110 connected to the pins 80 of the receptacle connector 700.

The fit between the electrical contacts 320 and the housing 90 within the cavities 95 may leave little room for radial expansion of the electrical contacts 320 when the pins 80 (from the plug connector 900 and/or the receptacle connector 700) are inserted into the electrical contacts 320. Thus, the electrical contacts 320 may be compressed against the surface of the cavities 95 in the housing 90, thereby providing radial pressure or force on the pins 80 such that the wires 326 in the electrical contacts 320 may be maintained in contact with the pins 80 (e.g., to prevent the pins 80 from inadvertently slipping out of the channels 22 as well as to provide sufficient normal force to ensure an uninterrupted connection having low resistance).

In certain embodiments, the pins 80 provided in the plug connector 900 may differ in structure and/or dimensions from the pins 80 provided in the receptacle connector 700. In certain embodiments, the pins 80 provided in the plug connector 900 may be intended for fewer engagement cycles. For example, the plug connector 900 may be formed by inserting the pins 80 into the gasket 100 and the electrical contacts 320 once (a single engagement cycle). Therefore, the pins in the plug connector 900 may have a relatively larger outer dimension (e.g., outer diameter) than the pins 80 provided in the receptacle connector 700 to assist in ensuring a stable connection. On the other hand, the pins 80 provided in the receptacle connector 700 may be intended for more frequent insertion and removal from the electrical contacts 320 (a higher number of engagement cycles) as the plug connector 900 is connected to and disconnected from the receptacle connector 700. Therefore, the pins in the receptacle connector 700 may have a relatively smaller outer dimension (e.g., outer diameter) to reduce wear on the pins of the receptacle connector 700 and/or the electrical contacts 320.

The disclosed electrical connectors may replace conventional electrical connectors, and may be used for a variety of applications, such as aerospace, defense, and commercial applications. For example, the disclosed electrical connectors may replace electrical connectors having wires that form a hyperboloid. The disclosed electrical connectors may retain some of the benefits of such connectors, such as providing a reliable electrical connection, but may also have a smaller size (e.g., diameter), be less expensive, and/or be less difficult to manufacture.

It will be apparent to those skilled in the art that various modifications and variations can be made in the disclosed systems and processes without departing from the scope of the disclosure. That is, other embodiments will be apparent to those skilled in the art from consideration of the specification and practice of the disclosure. It is intended that the specification and examples be considered as exemplary only, with a true scope being indicated by the following claims and their equivalents.

What is claimed is:

1. An electrical contact comprising:

a tubular body formed of a flexible and insulative material, the tubular body including an inner surface; and a plurality of wires, each of the plurality of wires extending along the tubular body and being partially embedded and fixed into the tubular body such that at least a portion of said each of the plurality of wires is exposed within the inner surface of the tubular body;

wherein at least a portion of the inner surface of the tubular body and at least the exposed portion of said each of the plurality of wires forms a channel.

2. The electrical contact of claim 1, wherein the channel is configured to receive a conductive structure, and said each of the plurality of wires is configured to form an electrical connection with the conductive structure when the conductive structure is inserted into the channel.

3. The electrical contact of claim 1, wherein a majority of said each of the plurality of wires is embedded into the tubular body.

4. The electrical contact of claim 1, wherein the plurality of wires are formed in a braided, criss-cross, helical, mesh, or generally straight configuration.

5. The electrical contact of claim 1, wherein the channel extends along an entire length of the tubular body.

6. The electrical contact of claim 1, wherein the flexible and insulative material includes at least one of a polymeric material or an elastomeric material.

7. The electrical contact of claim 1, wherein said each of the plurality of wires is formed of a conductive material.

8. The electrical contact of claim 1, wherein the plurality of wires are not exposed on an outer surface of the tubular body.

9. The electrical contact of claim 1, wherein the tubular body is configured to be formed by extrusion.

10. The electrical contact of claim 1, wherein the plurality of wires are partially embedded into the inner surface of the tubular body.

11. An electrical connector comprising:

an electrical contact comprising:

a tubular body formed of at least one of a polymeric material or an elastomeric material, the tubular body including an inner surface; and at least one wire partially embedded into the tubular body such that at least a portion of the at least one wire is exposed within the inner surface of the tubular body; and a termination device comprising:

a conductive portion attached to the at least one wire of the electrical contact, the termination device being configured to form an electrical connection with the electrical contact; and a cavity configured to receive a conductive structure of another electrical connector to form an electrical connection between the other electrical connector and the electrical contact;

wherein at least a portion of the inner surface of the tubular body and at least the exposed portion of the at least one wire forms a channel.

12. The electrical connector of claim 11, further comprising a housing including a plurality of cavities, wherein the electrical contact is one of a plurality of electrical contacts and said one of the plurality of electrical contacts is provided in each of the cavities of the housing.

13. The electrical connector of claim 11, further comprising:

a housing including at least one cavity;

the electrical contact is at least partially disposed within the at least one cavity of the housing;

the channel of the electrical contact is configured to receive the termination device; and the at least one wire is configured to form an electrical connection with the termination device when the termination device is received within the channel of the electrical contact.

14. The electrical connector of claim 11, wherein the at least one of the polymeric material or the elastomeric material is a flexible and insulative material.

15. The electrical connector of claim 11, wherein the termination device includes a pin.

16. An electrical connector comprising:

an electrical contact comprising:

a tubular body formed of at least one of a polymeric material or an elastomeric material, the tubular body including an inner surface; and at least one wire partially embedded into the tubular body such that at least a portion of the at least one wire is exposed within the inner surface of the tubular body;

wherein at least a portion of the inner surface of the tubular body and at least the exposed portion of the at least one wire forms a channel, the channel of the electrical contact being configured to receive a conductive structure;

wherein the at least one wire is configured to form an electrical connection with the conductive structure when the conductive structure is received within the channel of the electrical contact;

a housing including at least one cavity, the electrical contact being at least partially disposed within the at least one cavity of the housing, the at least one cavity in the housing connecting to a receptacle portion; and a gasket inserted into the receptacle portion and at least partially into the at least one cavity, at least a portion of the conductive structure being inserted in the gasket so that the gasket forms a seal between the conductive structure and the housing.

17. A method of forming an electrical connector, the method comprising:

forming at least one wire partially embedded into a tubular body to form an electrical contact, the tubular body being formed of a flexible and insulative material, the at least one wire being formed of a conductive material, the tubular body including an inner surface, at least a portion of the at least one wire being exposed within the inner surface of the tubular body so that at least a portion of the inner surface of the tubular body and at least the exposed portion of the at least one wire forms a channel;

attaching a conductive portion of a termination device to the at least one wire to form an electrical connection between the termination device and the electrical contact; and inserting a conductive structure of another electrical connector into a cavity of the termination device to form an electrical connection between the other electrical connector and the electrical contact.

18. The method of claim 17, wherein forming the at least one wire partially embedded into the tubular body includes forming a continuous length of the tubular body with the at least one wire partially embedded in the tubular body.

19. The method of claim 18, further including cutting off a desired length from the continuous length of the tubular body to form the electrical contact, wherein the electrical contact is seamless.

20. The method of claim 19, further including inserting the conductive portion of the termination device into the channel of the electrical contact to form the electrical connection between the electrical contact and the termination device.

* * * * *